US011742133B2

(12) United States Patent
Nakazawa

(10) Patent No.: US 11,742,133 B2
(45) Date of Patent: Aug. 29, 2023

(54) ELECTRONIC COMPONENT, BONDING STRUCTURE, POWER SUPPLY DEVICE, AND ELECTRIC VEHICLE

(71) Applicant: SONY CORPORATION, Tokyo (JP)

(72) Inventor: Hirofumi Nakazawa, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 1249 days.

(21) Appl. No.: 16/314,992

(22) PCT Filed: Apr. 10, 2017

(86) PCT No.: PCT/JP2017/014612
§ 371 (c)(1),
(2) Date: Jan. 3, 2019

(87) PCT Pub. No.: WO2018/012065
PCT Pub. Date: Jan. 18, 2018

(65) Prior Publication Data

US 2019/0252112 A1 Aug. 15, 2019

(30) Foreign Application Priority Data

Jul. 11, 2016 (JP) ..... 2016-136736

(51) Int. Cl.
*H01F 27/28* (2006.01)
*H01F 30/10* (2006.01)

(52) U.S. Cl.
CPC ..... *H01F 27/2823* (2013.01); *H01F 27/28* (2013.01); *H01F 30/10* (2013.01)

(58) Field of Classification Search
CPC ..... H01F 27/2823
USPC ..... 336/220
See application file for complete search history.

(56) References Cited

U.S. PATENT DOCUMENTS 6,522,233 B1 * 2/2003 Kyoso ..... H01F 27/324 336/200
9,000,878 B1 * 4/2015 Lazzerini ..... H01F 27/2895 336/229
9,378,883 B2 * 6/2016 Tsai ..... H01F 27/324
2010/0033282 A1 * 2/2010 Hsu ..... H05K 1/141 336/65
2010/0188830 A1 * 7/2010 Tsai ..... H01F 27/2847 361/782
2011/0221558 A1 * 9/2011 Yeh ..... H01F 27/2847 336/192

(Continued)

FOREIGN PATENT DOCUMENTS

JP H07-038260 2/1995
JP 2004-303823 10/2004

(Continued)

OTHER PUBLICATIONS

Extended European Search Report for European Patent Application No. 17827199.5, dated Jul. 4, 2019, 11 pages.

(Continued)

*Primary Examiner* — Ronald Hinson
(74) *Attorney, Agent, or Firm* — SHERIDAN ROSS P.C.

(57) ABSTRACT

Provided is an electronic component including a secondary side coil including a plurality of coil parts, in which each of the coil parts includes: a plate-like base part; a leg part formed on the base part; and a pin part formed at a tip of the leg part.

19 Claims, 19 Drawing Sheets

(56) References Cited

U.S. PATENT DOCUMENTS

| | | | | |
|---|---|---|---|---|
| 2013/0141878 | A1* | 6/2013 | Wu | H01F 27/2866 361/748 |
| 2013/0188329 | A1* | 7/2013 | Chang | H05K 1/18 361/836 |
| 2014/0062634 | A1* | 3/2014 | Hsu | H01F 27/306 336/60 |
| 2016/0086718 | A1* | 3/2016 | Tsai | H01F 27/324 336/221 |

FOREIGN PATENT DOCUMENTS

| | | |
|---|---|---|
| JP | 2008-270347 | 11/2008 |
| JP | 2009-032992 | 2/2009 |
| JP | 2014-233192 | 12/2014 |

OTHER PUBLICATIONS

Official Action (with English translation) for Chinese Patent Application No. 201780042015.6, dated Oct. 28, 2020, 15 pages.

International Search Report prepared by the Japan Patent Office dated Jun. 21, 2017, for International Application No. PCT/JP2017/014612.

* cited by examiner

ELECTRONIC COMPONENT, BONDING STRUCTURE, POWER SUPPLY DEVICE, AND ELECTRIC VEHICLE

CROSS REFERENCE TO RELATED APPLICATIONS

This application is a national stage application under 35 U.S.C. 371 and claims the benefit of PCT Application No. PCT/JP2017/014612 having an international filing date of 10 Apr. 2017, which designated the United States, which PCT application claimed the benefit of Japanese Patent Application No. 2016-136736 filed 11 Jul. 2016, the entire disclosures of each of which are incorporated herein by reference.

TECHNICAL FIELD

The present disclosure relates to an electronic component, a bonding structure, a power supply device, and an electric vehicle.

BACKGROUND ART

Conventionally, various proposals relating to power supply units used for electronic devices have been made. For example, Patent Document 1 below describes a transformer used for a power supply unit. Incidentally, as a standard of conversion efficiency in a power supply unit when conversion from alternating current to direct current is performed, there is a standard called "80Plus". In the standard, a highest level of conversion efficiency is required in a level of titanium (Titanium).

CITATION LIST

Patent Document

Patent Document 1: JP 2008-270347 A

SUMMARY OF THE INVENTION

Problems to be Solved by the Invention

In such a field, it is desired to reduce loss in the power supply unit and achieve high efficiency in order to satisfy a higher level in the above-described standard, for example.

Therefore, one object of the present disclosure is to provide an electronic component, a bonding structure, a power supply device, and an electric vehicle, which are capable of achieving high efficiency.

Solutions to Problems

In order to achieve the above-described object, the present disclosure is, for example, an electronic component including a secondary side coil including a plurality of coil parts, in which the coil part includes:

a plate-like base part;

a leg part formed on the base part; and a pin part formed at a tip of the leg part.

Further, the present disclosure is, for example, an electronic component including a secondary side coil including a plurality of coil parts, in which the coil part includes:

a plate-like base part;

a leg part formed on the base part; and at least one of a pin part formed at a tip of the leg part or a hole formed in the vicinity of the tip.

Further, the present disclosure is, for example, a bonding structure including:

a plurality of first members arranged in a predetermined direction; and a second member that supports the plurality of first members, in which a solder inflow space along the predetermined direction is formed in a state where the plurality of first members is supported by the second member.

Further, the present disclosure may be a power supply device including the above-described electronic component.

Further, the present disclosure may be an electric vehicle including the power supply device.

Effects of the Invention

According to at least one embodiment of the present disclosure, loss in a power supply unit can be reduced to achieve high efficiency. Note that effects of the present disclosure is not necessarily limited to the effect described above, but may include any effect described herein. Further, content of the present disclosure should not be interpreted as limited by the exemplary effects.

MODE FOR CARRYING OUT THE INVENTION

Hereinafter, an embodiment and the like of the present disclosure will be described with reference to the drawings. Note that the description will be given in the following order.

<1. One Embodiment>

<2. Application Example>

<3. Modification>

The embodiments and the like described below are preferred specific examples of the present disclosure, and content of the present disclosure is not limited to these embodiments and the like.

Further, in the following description, expressions that define directions such as upward, downward, leftward, and rightward on the basis of illustrated directions or the like may be used, but this is for facilitating understanding of the present disclosure, and the content of the present disclosure is not limited to the directions. Further, the illustrated directions or illustrated sizes of members may be appropriately changed, for facilitating the understanding of the present disclosure.

1. One Embodiment

Configuration Example of Power Supply Unit

Figure 1:
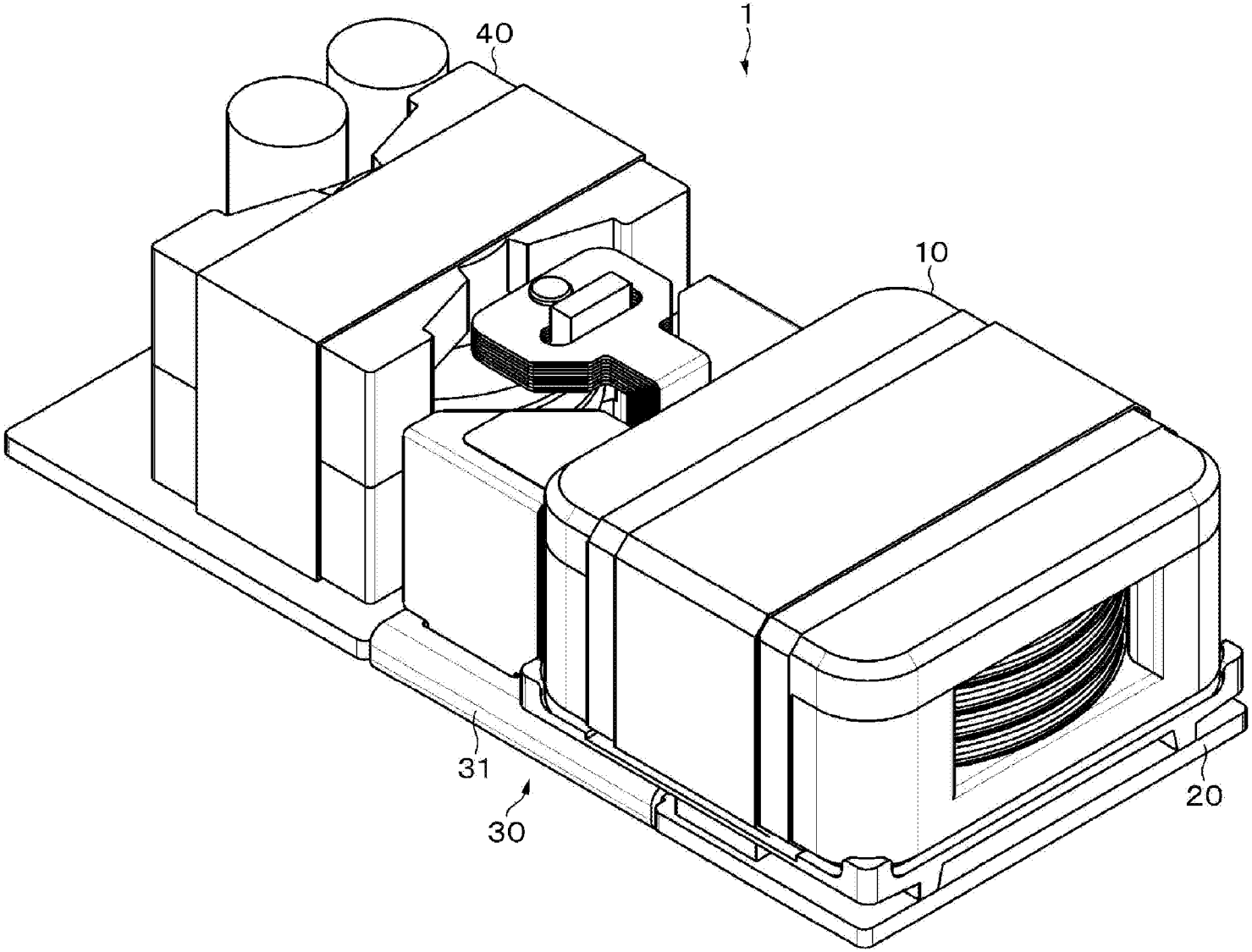
FIG. 1 is a perspective view illustrating an appearance example of a power supply unit according to an embodiment of the present disclosure.

FIG. 1 is a perspective view illustrating an appearance example of a power supply unit (a power supply unit 1) according to an embodiment of the present disclosure. The power supply unit 1 includes, for example, a transformer (transformer) 10 as an example of an electronic component, a substrate 20, a bus bar 30, and a choke coil 40. The bus bar 30 in the present embodiment includes two bus bars (bus bars 31 and 32).

Figure 2:
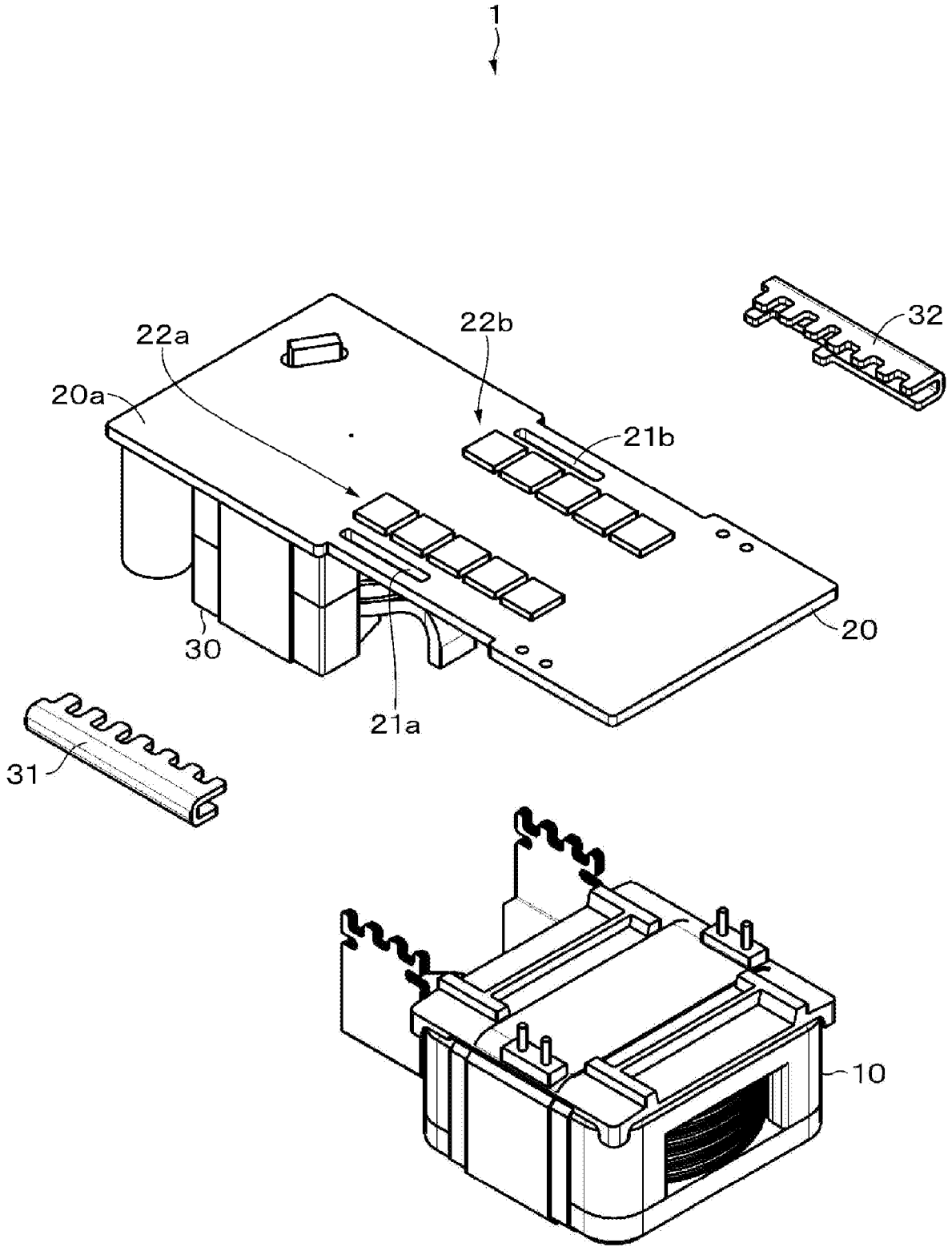
FIG. 2 is an exploded perspective view for describing a configuration example of the power supply unit according to the embodiment of the present disclosure.

FIG. 2 is an exploded perspective view of the power supply unit 1 as seen from a side of a back surface 20*a* of the substrate 20. A configuration of the power supply unit 1 will be schematically described. Rectangular through holes 21*a* and 21*b* are formed in the substrate 20. A circuit component such as a field effect transistor (FET) is connected to the back surface 20*a* of the substrate 20. For example, a plurality of circuit components 22*a* is connected in the vicinity of the through hole 21*a*, and a plurality of circuit components 22*b* is formed in the vicinity of the through hole 21*b*. These circuit components are connected to a circuit pattern which is formed on the back surface 20*a* and includes copper foil or the like (not illustrated).

Pin parts of a secondary side coil of the transformer 10 as described later are inserted into the through holes 21*a* and 21*b*. Then, after the bus bars 31 and 32 are attached from sides of side surfaces of the substrate 20 to the pin parts exposed on the side of the back surface 20*a*, soldering is performed from the side of the back surface 20*a*. With this arrangement, each of the pin parts and the bus bars 31 and 32 are solder-bonded to be electrically connected to the circuit components 22*a* and 22*b* via the circuit pattern. Note that any method can be applied as a soldering method, including a known method such as a so-called flow method and a method which is manually performed.

Configuration Example of Transformer

Figure 3:
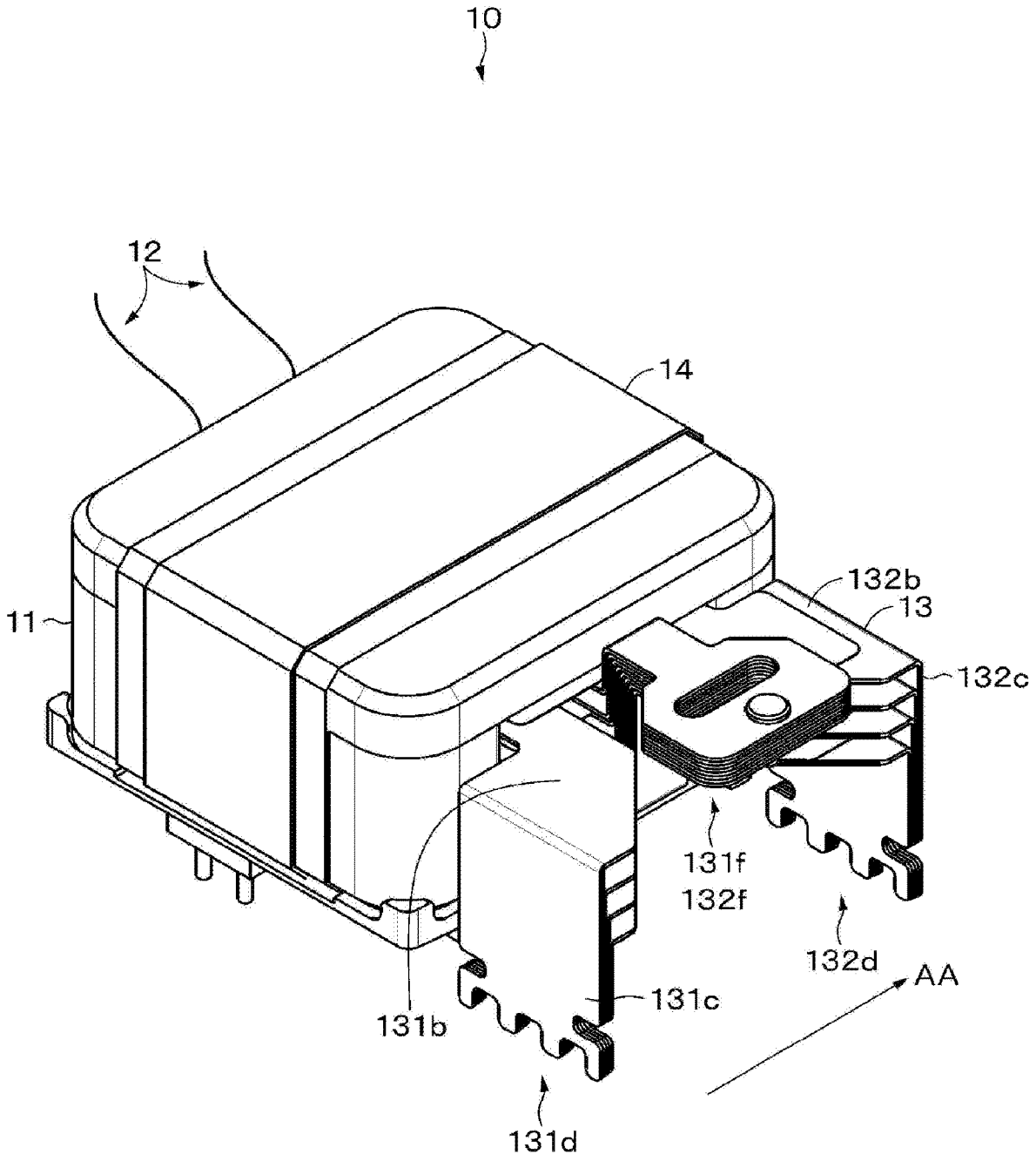
FIG. 3 is a perspective view illustrating an appearance example of a transformer according to the embodiment of the present disclosure.

Next, a configuration example of the transformer 10 according to the embodiment of the present disclosure will be described with reference to FIGS. 3 to 5. FIG. 3 is a perspective view illustrating an appearance example of the transformer 10. The transformer 10 includes, for example, a core 11, a primary side coil 12, a secondary side coil 13, and an exterior tape 14 such as a polyester tape.

As a material of the core 11, a magnetic material such as ferrite can be used. Depending on a use of the transformer 10, the material of the core 11 can be changed from ferrite to a silicon-containing material such as a highlight material, an orientation material, and an amorphous material, or permalloy or the like can also be used as the material of the core 11. Any shape such as an E-shape can be applied to the core 11.

The primary side coil 12 includes an insulation coated wire and the like such as a litz wire and a stranded wire, wound with a predetermined number of turns. End parts (winding start part and winding end part) of the primary side coil 12 are exposed to be connected to appropriate portions. For example, the primary side coil 12 has a configuration in which four layers are formed by connecting two layers formed by one coil in parallel. Details of the secondary side coil 13 will be described later. After each component of the transformer 10 is assembled as described later, the components are integrally fixed by the exterior tape 14.

Regarding Secondary Side Coil

Next, details of the secondary side coil 13 according to the embodiment of the present disclosure will be described. The secondary side coil 13 includes, for example, a plurality of coil parts, more specifically, a plurality of first coil parts 13*a* and a plurality of second coil parts 13*b*.

Figure 4:
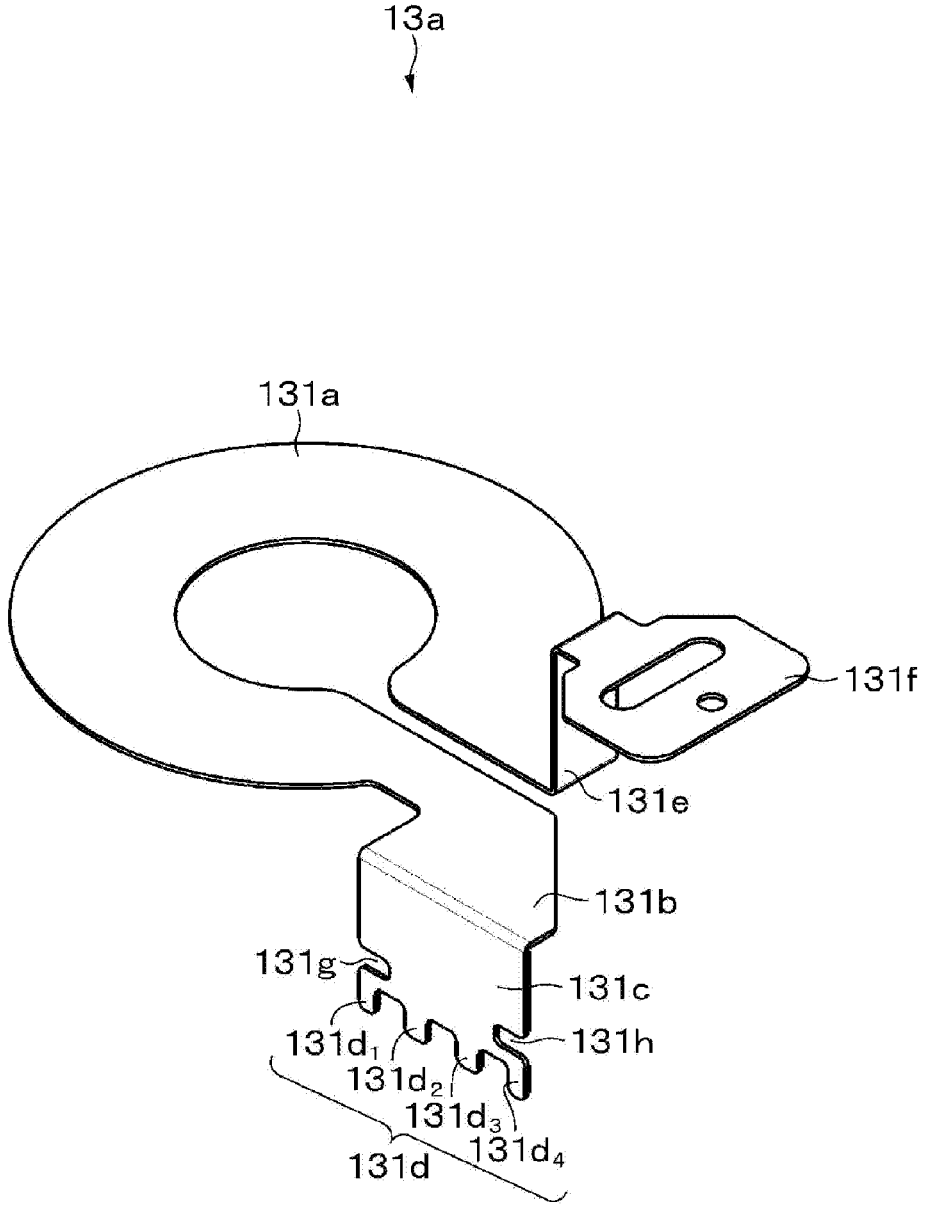
FIG. 4 is a perspective view for describing an example of a shape of a first coil part according to the embodiment of the present disclosure.

FIG. 4 is a perspective view illustrating a configuration example of the first coil part 13*a*. The first coil part 13*a* includes, for example, a plate-like (for example, thin plate shape having a thickness of 0.1 to several millimeters (mm)) base part 131*a* having a disk shape (C shape), a coupling part 131*b* extending in a horizontal direction from one end side of the base part 131*a*, a leg part 131*c* formed downward from the coupling part 131*b*, a pin part 131*d* formed at a tip of the leg part 131*c*, a planted part 131*e* planted upward from another end side of the base part 131*a*, and a flange part 131*f* extending outward in the horizontal direction from a tip of the planted part 131*e*, and these parts are formed continuously.

The pin part 131*d* includes, for example, a plurality of pins, and in the present embodiment, the pin part 131*d* includes four pins (a pin 131$d_1$, a pin 131$d_2$, a pin 131$d_3$, and a pin 131$d_4$).

In the leg part 131*c*, notches 131*g* and 131*h* as examples of portions supported by a support part of the bus bar 31 as described later are formed. For example, the notches 131*g* and 131*h* are oval through holes formed from the outside to the inside of the leg part 131*c*. Of course, shapes of the notches 131*g* and 131*h* can be changed appropriately. The notches 131*g* and 131*h* are not necessarily required to communicate with the outside of the leg part 131*c*, and may be holes or the like formed in the leg part 131*c*.

A conductive material can be used as a material of the first coil part 13*a*, and in present embodiment, tough pitch copper is used. Surface treatment such as application of tin plating may be performed on a surface of the first coil part 13*a* to prevent oxidation (prevent rust).

Figure 5:
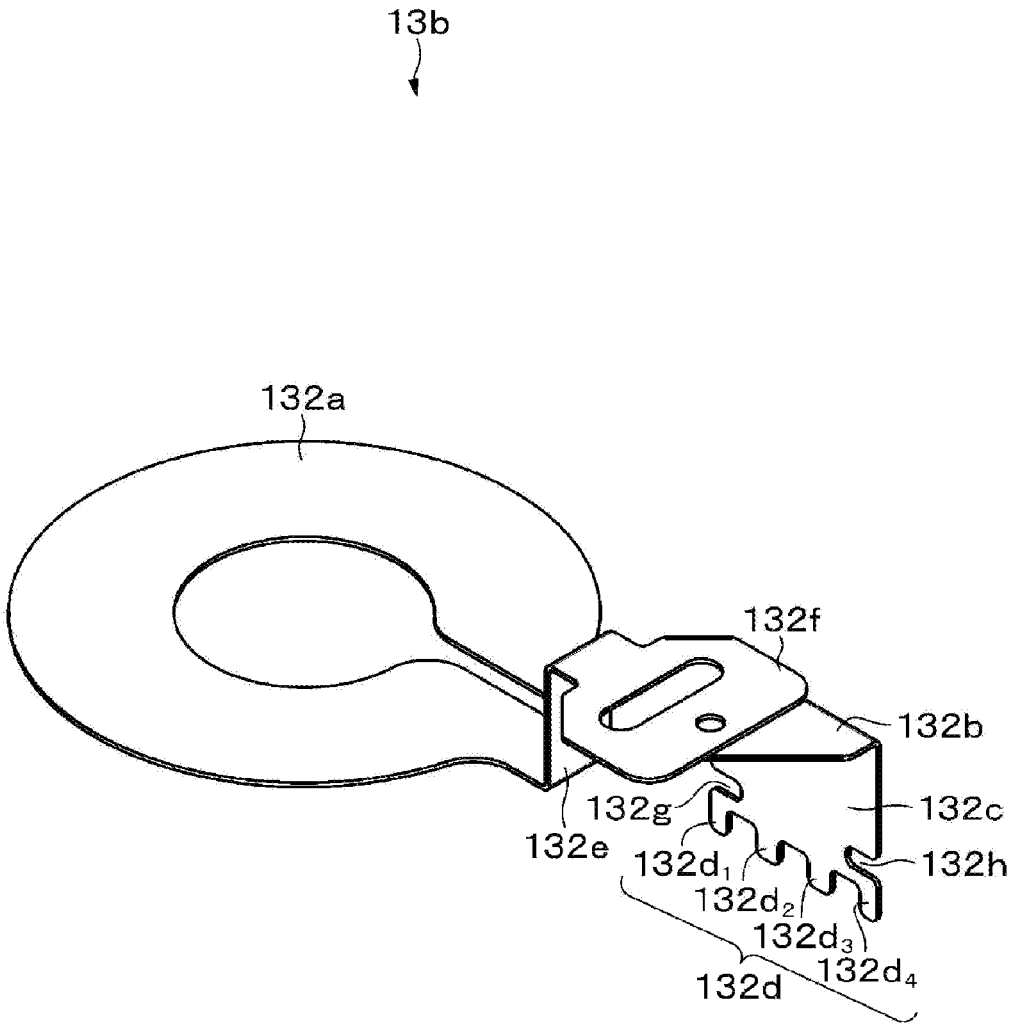
FIG. 5 is a perspective view for describing an example of a shape of a second coil part according to the embodiment of the present disclosure.

FIG. 5 is a perspective view illustrating a configuration example of the second coil part 13*b*. The second coil part 13*b* as a whole has substantially the same size as the first coil part 13*a*, and is different in shape from the first coil part 13*a* in that end parts where the leg part and the planted part are formed in the base part are reversed in position.

FIG. 5 is the perspective view illustrating the configuration example of the second coil part 13*b*. The second coil part 13*b* includes, for example, a plate-like (for example, thin plate shape having a thickness of 0.1 to several mm) base part 132*a* having a disk shape (C shape), a coupling part 132*b* extending in a horizontal direction from one end side of the base part 132*a* (a portion corresponding to the another end side in the base part 131*a*), a leg part 132*c* formed downward from the coupling part 132*b*, a pin part 132*d* formed at a tip of the leg part 132*c*, a planted part 132*e* planted upward from another end side of the base part 132*a* (a portion corresponding to the one end side in the base part 131*a*), and a flange part 132*f* extending outward in the horizontal direction from a tip of the planted part 132*e*, and these parts are formed continuously.

The pin part 132*d* includes, for example, a plurality of pins, and in the present embodiment, the pin part 132*d* includes four pins (a pin $\mathbf{132}d_1$, a pin $\mathbf{132}d_2$, a pin $\mathbf{132}d_3$, and a pin $\mathbf{132}d_4$).

In the leg part 132*c*, notches 132*g* and 132*h* as examples of portions supported by a support part of the bus bar 32 as described later are formed. For example, the notches 132*g* and 132*h* are oval through holes formed from the outside to the inside of the leg part 132*c*. Of course, shapes of the notches 132*g* and 132*h* can be changed appropriately. The notches 132*g* and 132*h* are not necessarily required to communicate with the outside of the leg part 132*c*, and may be holes or the like formed in the leg part 132*c*.

A conductive material can be used as a material of the second coil part 13*b*, and in present embodiment, tough pitch copper is used similarly to the case of the first coil part 13*a*. Surface treatment such as application of tin plating may be performed on a surface of the second coil part 13*b* to prevent oxidation (prevent rust).

In the present embodiment, the secondary side coil 13 has a configuration including four first coil parts 13*a* and four second coil parts 13*b*, in which the first coil parts 13*a* and the second coil parts 13*b* are stacked in a vertical direction to form eight layers in the vertical direction. By adopting such a multilayered configuration, it is possible to increase an effective conductor area (an area through which current flows) of the coil part, and can apply a large current. Moreover, with the multilayered configuration, it is possible to effectively use the effective conductor area even in a case where a drive frequency for switching is a high frequency (for example, 100 kilohertz (kHz) to 200 kHz), and therefore an influence of a skin effect and the like can be reduced. Note that that the number of layers can be increased or decreased appropriately depending on an application amount of current or the like.

The coupling parts 131*b* and the leg parts 131*c* are appropriately set to have different heights (vertical lengths) in the four first coil parts 13*a*, and in a state where the four first coil parts 13*a* are stacked, positions of the pin parts 131*d* in a height direction are arranged at substantially the same position. Similarly, the coupling parts 132*b* and the leg parts 132*c* are appropriately set to have different heights (vertical lengths) in the four second coil parts 13*b*, and in a state where the four second coil parts 13*b* are stacked, positions of the pin parts 132*d* in the height direction are arranged at substantially the same position.

In a state where the first coil parts 13*a* and the second coil parts 13*b* are stacked, the leg parts 131*c* and 132*c* are arranged to face each other. Moreover, the leg parts 131*c* of the first coil parts 13*a* and the leg parts 132*c* of the second coil parts 13*b* are arranged along a predetermined direction (a direction indicated by a reference sign AA in FIG. 3).

Further, the planted parts 131*e* and 132*e* are appropriately set to have different heights (vertical lengths), and in a state where the first and second coil parts 13*a* and 13*b* are stacked, the secondary side coil 13 includes the flange parts 131*f* and 132*f* forming eight layers in the vertical direction (see FIG. 3).

Moreover, positions where the notches 131*g* and 131*h* are formed in each first coil part 13*a* are set such that the positions in the height direction of the notches 131*g* and 131*h* in the leg parts 131*c* are substantially the same positions when the four first coil parts 13*a* are stacked. Similarly, positions where the notches 132*g* and 132*h* are formed in each second coil part 13*b* are set such that the positions in the height direction of the notches 132*g* and 132*h* in the leg parts 132*c* are substantially the same positions when the four second coil parts 13*b* are stacked.

Arrangement Example of Primary Side and Secondary Side Coils

Figure 6:
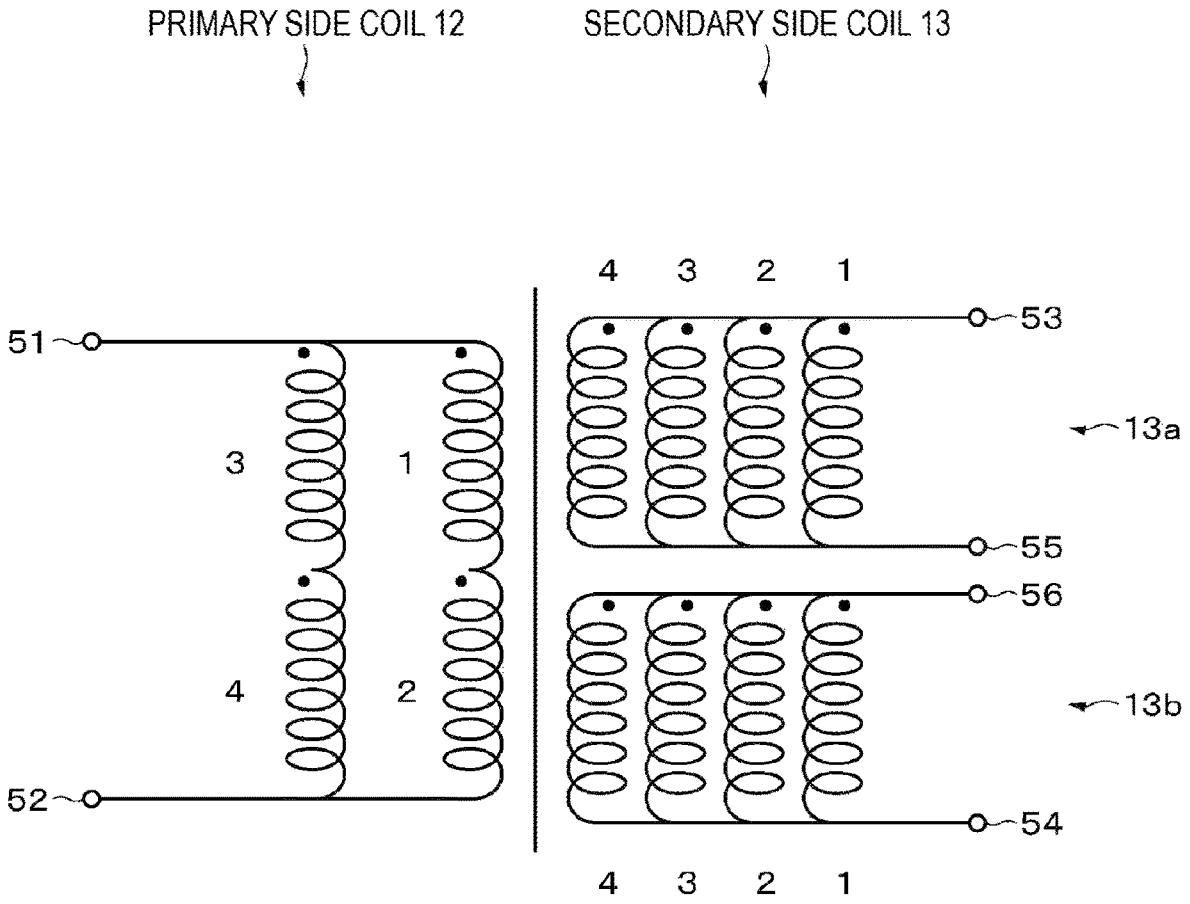
FIG. 6 is a connection diagram for describing a connection example of the transformer according to the embodiment of the present disclosure.

FIG. 6 is a connection diagram of the transformer 10. Terminals 51 and 52 are respectively connected to a start end (winding start part) and a terminal end (winding end part) of the primary side coil 12. Terminals 53 and 54 correspond to polarity in accordance with a control method of the transformer 10, and terminals 55 and 56 correspond to ground (GND). In the present embodiment, the pin part 131*d* of the first coil part 13*a* is connected to the terminal 53, and the flange Part 131*f* is connected to the terminal 55. Further, the pin part 132*d* of the second coil part 13*b* is connected to the terminal 54, and the flange part 132*f* is connected to the terminal 56. The first and second coil parts 13*a* and 13*b* may be reversely connected to each terminal. The terminals 55 and 56 are connected to the choke coil 40 by solder, for example.

Figure 7:
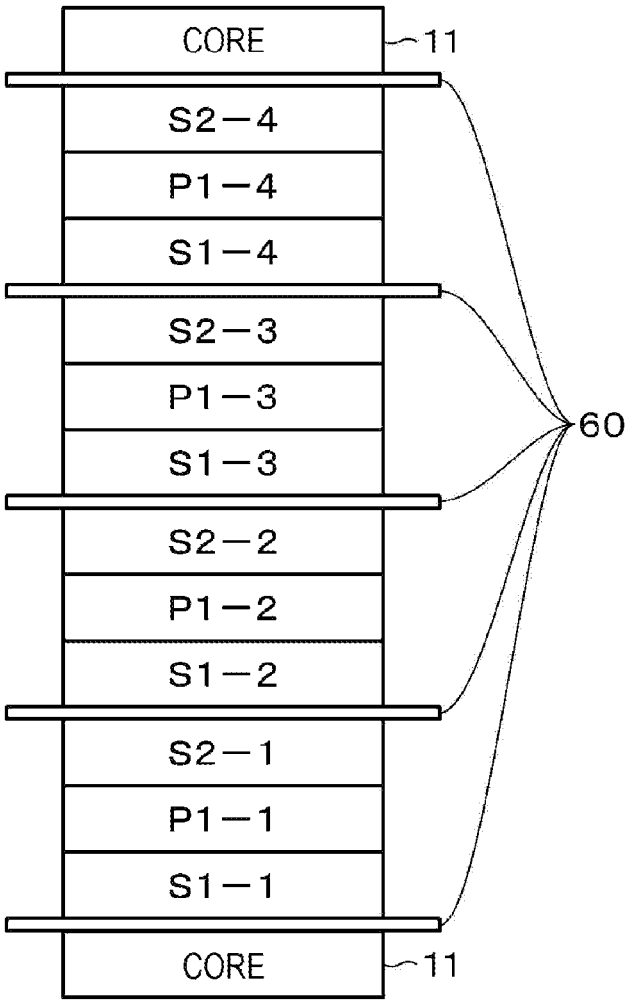
FIG. 7 is a diagram for describing a configuration example of the transformer according to the embodiment of the present disclosure.

As illustrated in FIG. 7, for example, each layer of the first and second coil parts 13*a* and 13*b* is disposed above or below each layer of the primary side coil 12. Specifically, a set is formed in which the base part 131*a* of the first coil part 13*a* (S (Secondary) 1-1) positioned in a lowermost layer is arranged on a lower side of layers forming a primary coil (P (Primary) 1-1) of the primary side coil 12, and the base part 132*a* of the second coil part 13*b* (S2-1) positioned in a lowermost layer is arranged on an upper side of the layers forming the primary coil (P (Primary) 1-1). Further, a set is formed in which the base part 131*a* of the first coil part 13*a* (S1-2) positioned in a second layer from the lowermost layer is arranged on a lower side of layers forming a secondary coil (P1-2) of the primary side coil 12, and the base part 132*a* of the second coil part 13*b* (S2-2) positioned in a second layer from the lowermost layer is arranged on an upper side of the layers forming the secondary coil (P1-2). Other sets are formed similarly, and four pairs are formed in total. Then, the sets are insulated from one another using insulating sheets 60 or the like. With this configuration, a coupling coefficient can be increased, and power conversion efficiency from a primary side to a secondary side can be improved.

Configuration Example of Bus Bar

Figure 8A:
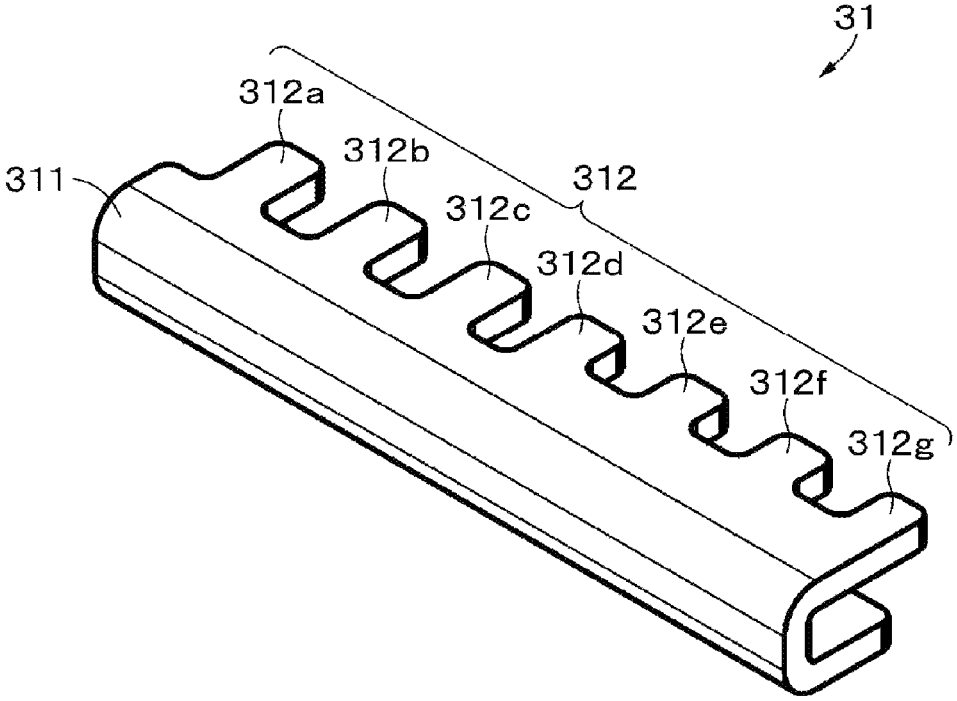
FIGS. 8A and 8B are perspective views for describing an example of a shape of a bus bar according to the embodiment of the present disclosure.
Figure 8B:
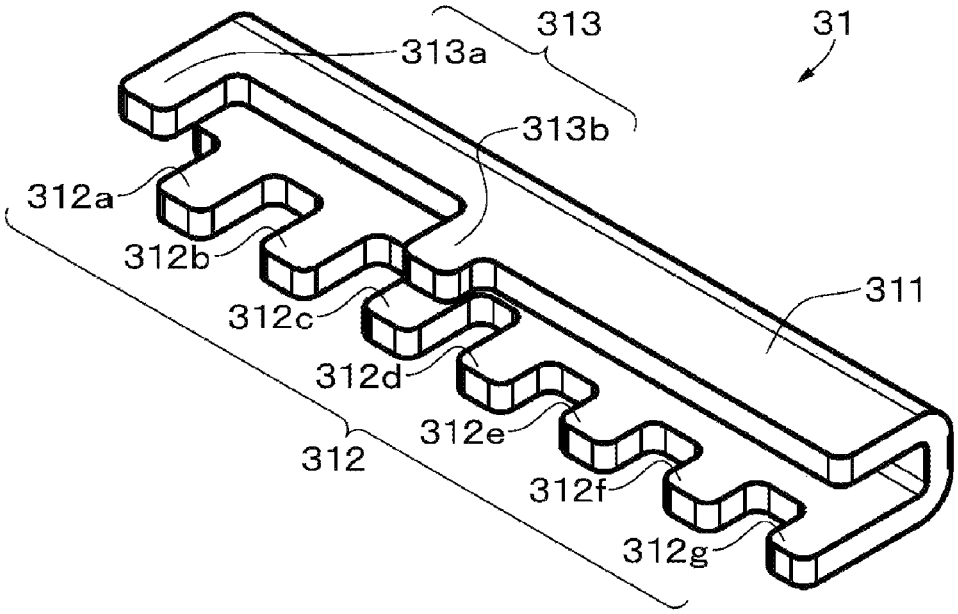

Next, a configuration example of the bus bars 31 and 32 will be described. FIGS. 8A and 8B are perspective views illustrating the configuration example of the bus bar 31, in which upper and lower sides of the bus bar 31 are reversed. The bus bar 31 includes a base 311 having a U-shaped cross section in a short direction. On one end side of the base 311, a protruded part 312 including a plurality of protrusions is formed. In the present embodiment, the protruded part 312 includes seven protrusions (312*a*, 312*b*, 312*c*, . . . , 312*g*). Further, on another end side of the base 311, a support part 313 is formed. In the present embodiment, the support part 313 includes two protrusions 313*a* and 313*b* corresponding to the number of the notches 131*g* and 131*h*.

Figure 9A:
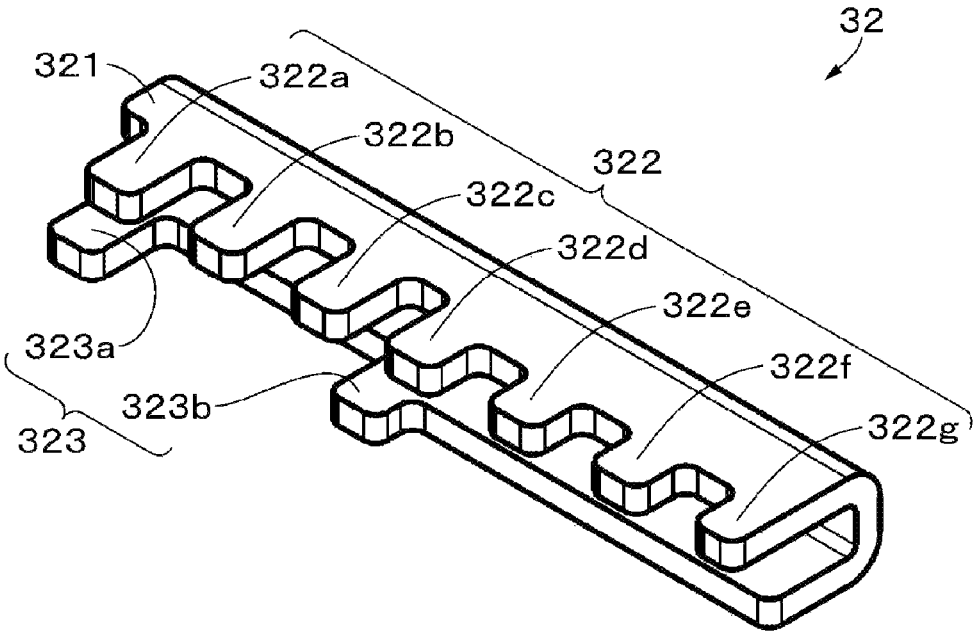
FIGS. 9A and 9B are perspective views for describing an example of the shape of the bus bar according to the embodiment of the present disclosure.
Figure 9B:
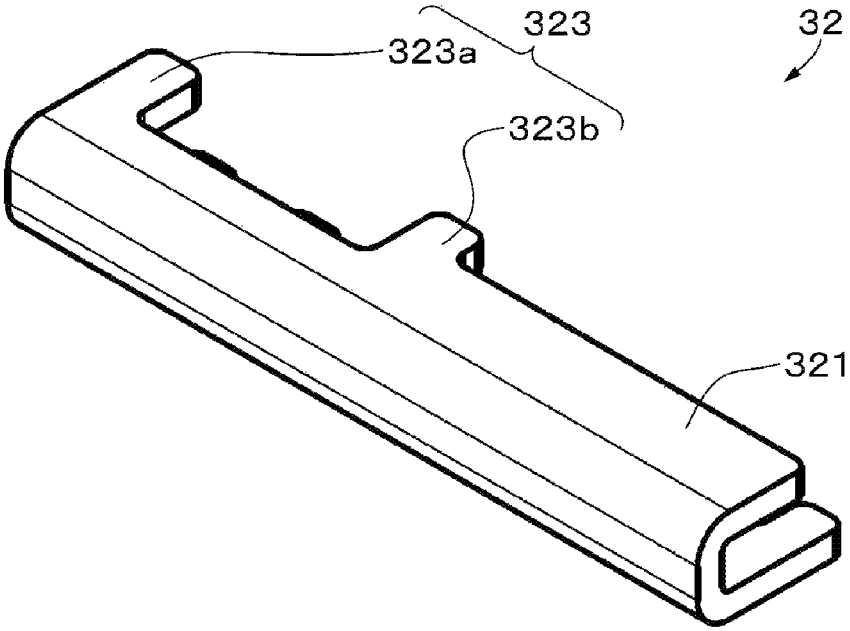

FIGS. 9A and 9B are perspective views illustrating the configuration example of the bus bar 32, in which upper and lower sides of the bus bar 32 are reversed. The bus bar 32 includes a base 321 having a U-shaped cross section in a short direction. On one end side of the base 321, a protruded part 322 including a plurality of protrusions is formed. In the present embodiment, the protruded part 322 includes seven protrusions (322*a*, 322*b*, 322*c*, . . . , 322*g*). Further, on another end side of the base 321, a support part 323 is formed. In the present embodiment, the support part 323 includes two protrusions 323*a* and 323*b* corresponding to the number of the notches 132*g* and 132*h*.

Figure 10A:
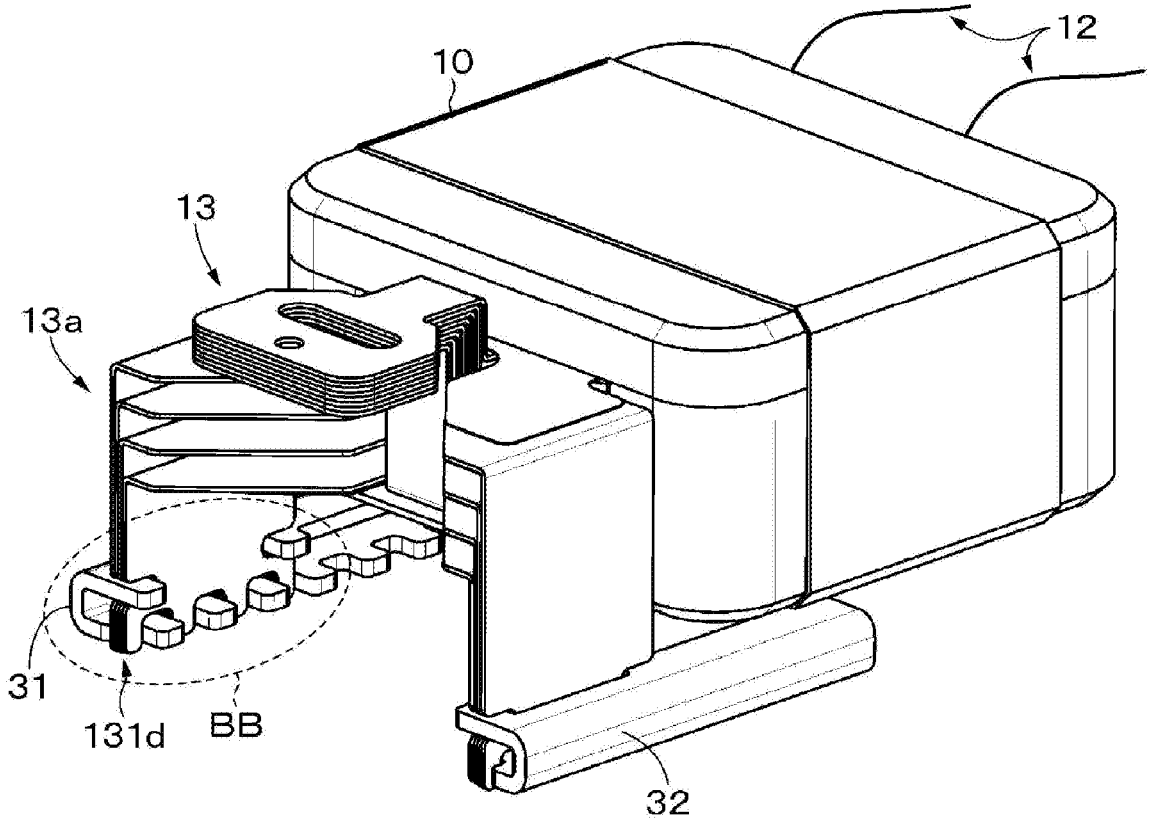
FIGS. 10A and 10B are views for describing an example of attaching the bus bar to the first coil part.
Figure 10B:
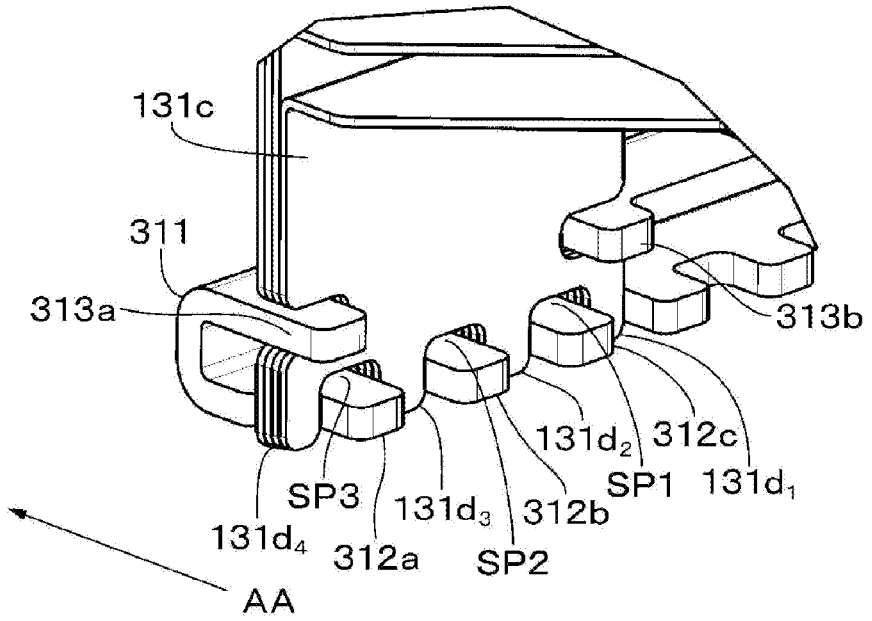

Next, an example of attaching the above-described bus bars 31 and 32 to the secondary side coil 13 will be described. FIGS. 10A and 10B are views for describing an example of attaching the bus bar 31 to the secondary side coil 13. FIG. 10A is a view illustrating a state where the bus bar 31 is attached to the secondary side coil 13, and FIG. 10B is an enlarged view of a portion surrounded by a dotted line and denoted by a reference sign BB in FIG. 10A. Note that, in FIGS. 10A and 10B, the substrate 20 is not illustrated for convenience of description.

As illustrated in FIGS. 10A and 10B, the protrusions 313*a* and 313*b* constituting the support part 313 are respectively inserted into the notches 131*g* and 131*h* of the four first coil parts 13*a*. With this arrangement, the leg parts 131*c* of the four first coil parts 13*a* are integrally supported in the height direction, and each of the protrusions constituting the protruded part 312 is inserted between the pins so as to intersect with the pin part 131*d*. In the present example, the protrusion 312*c* is inserted between the pin $\mathbf{131}d_1$ and the pin $\mathbf{131}d_2$, the protrusion 312*b* is inserted between the pin $\mathbf{131}d_2$ and the pin $\mathbf{131}d_3$, and the protrusion 312*a* is inserted between the pin $\mathbf{131}d_3$ and the pin $\mathbf{131}d_4$. In this manner, each pin of the pin part 131*d* and each protrusion of the bus bar 31 intersect like a grid.

In a state where the bus bar 31 is attached to the first coil part 13*a*, a space into which solder flows is formed between the pin part 131*d* and the protruded part 312. This space communicates, for example, with an internal space defined by the base 311 of the bus bar 31 along an arrangement direction AA of the leg parts 131*c*. Specifically, a space SP1 is formed among the pin $\mathbf{131}d_1$, the pin $\mathbf{131}d_2$, and the protrusion 312*c*. A space SP2 is formed among the pin $\mathbf{131}d_2$, the pin $\mathbf{131}d_3$, and the protrusion 312*b*. A space SP3 is formed among the pin $\mathbf{131}d_3$, the pin $\mathbf{131}d_4$, and the protrusion 312*a*.

Figure 11A:
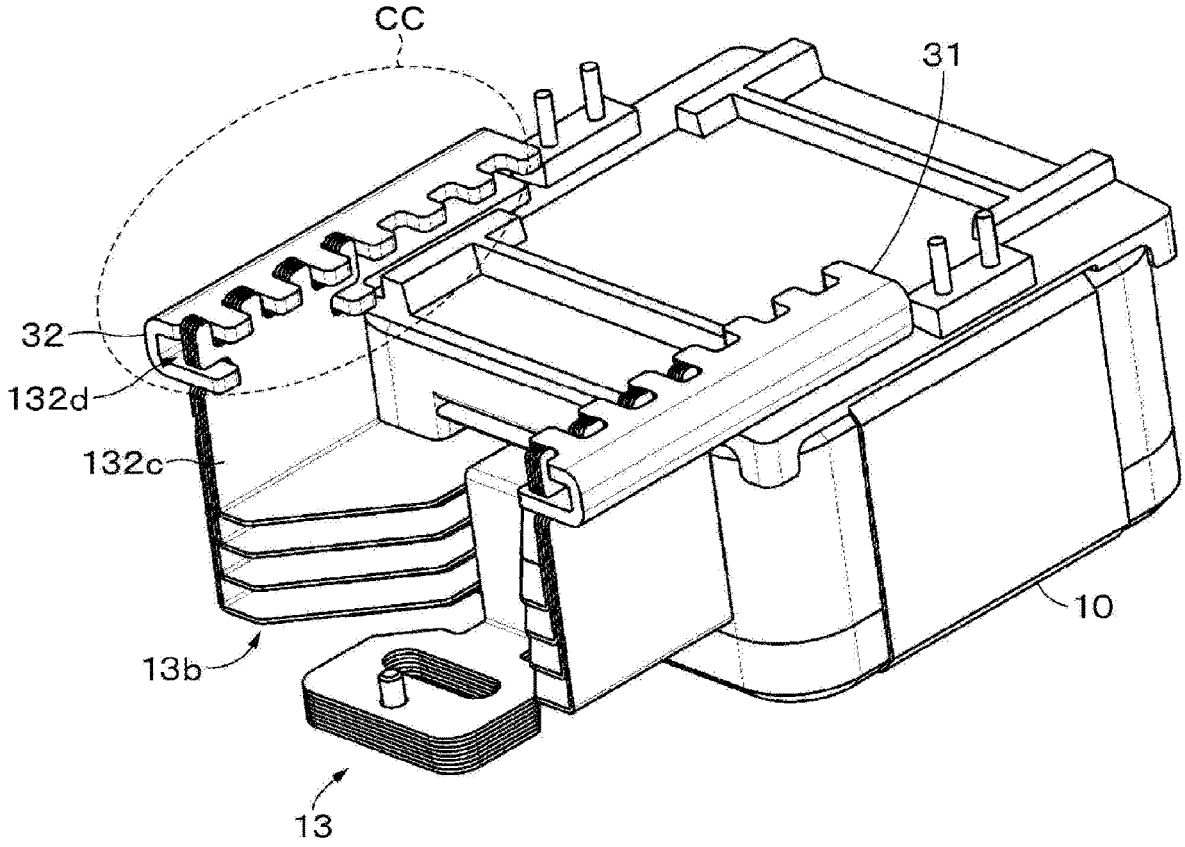
FIGS. 11A and 11B are views for describing an example of attaching the bus bar to the second coil part.
Figure 11B:
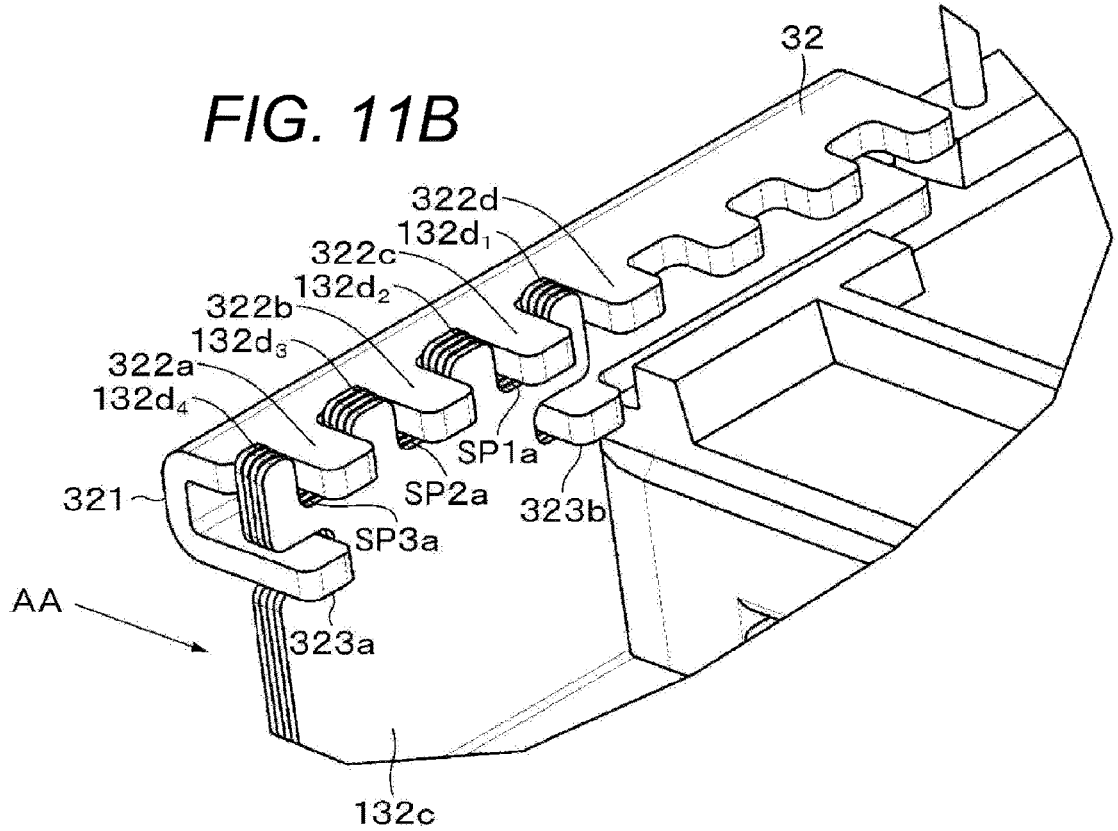

FIGS. 11A and 11B are views for describing an example of attaching the bus bar 32 to the secondary side coil 13. FIG. 11A is a view illustrating a state where the bus bar 32 is attached to the secondary side coil 13, and FIG. 11B is an enlarged view of a portion surrounded by a dotted line and denoted by a reference sign CC in FIG. 11A. Note that, in FIGS. 11A and 11B, the substrate 20 is not illustrated for convenience of description.

As illustrated in FIGS. 11A and 11B, the protrusions 323*a* and 323*b* constituting the support part 323 are respectively inserted into the notches 132*g* and 132*h* of the four second coil parts 13*b*. With this arrangement, the leg parts 132*c* of the four second coil parts 13*b* are integrally supported in the height direction, and each of the protrusions constituting the protruded part 322 is inserted between the pins so as to intersect with the pin part 132*d*. In the present example, the protrusion 322*c* is inserted between the pin $\mathbf{132}d_1$ and the pin $\mathbf{132}d_2$, the protrusion 322*b* is inserted between the pin $\mathbf{132}d_2$ and the pin $\mathbf{132}d_3$, and the protrusion 322*a* is inserted between the pin $\mathbf{131}d_3$ and the pin $\mathbf{131}d_4$.

In a state where the bus bar 32 is attached to the second coil part 13*b*, a space into which solder flows is formed between the pin part 132*d* and the protruded part 322. This space communicates, for example, with an internal space defined by the base 321 of the bus bar 32 along an arrangement direction of the leg parts 132*c*. Specifically, a space SP1*a* is formed among the pin $\mathbf{132}d_1$, the pin $\mathbf{132}d_2$, and the protrusion 322*c*. A space SP2*a* is formed among the pin $\mathbf{131}d_2$, the pin $\mathbf{131}d_3$, and the protrusion 322*b*. A space SP3*a* is formed among the pin $\mathbf{131}d_3$, the pin $\mathbf{131}d_4$, and the protrusion 322*a*.

One Example of Bonding Structure

Figure 12:
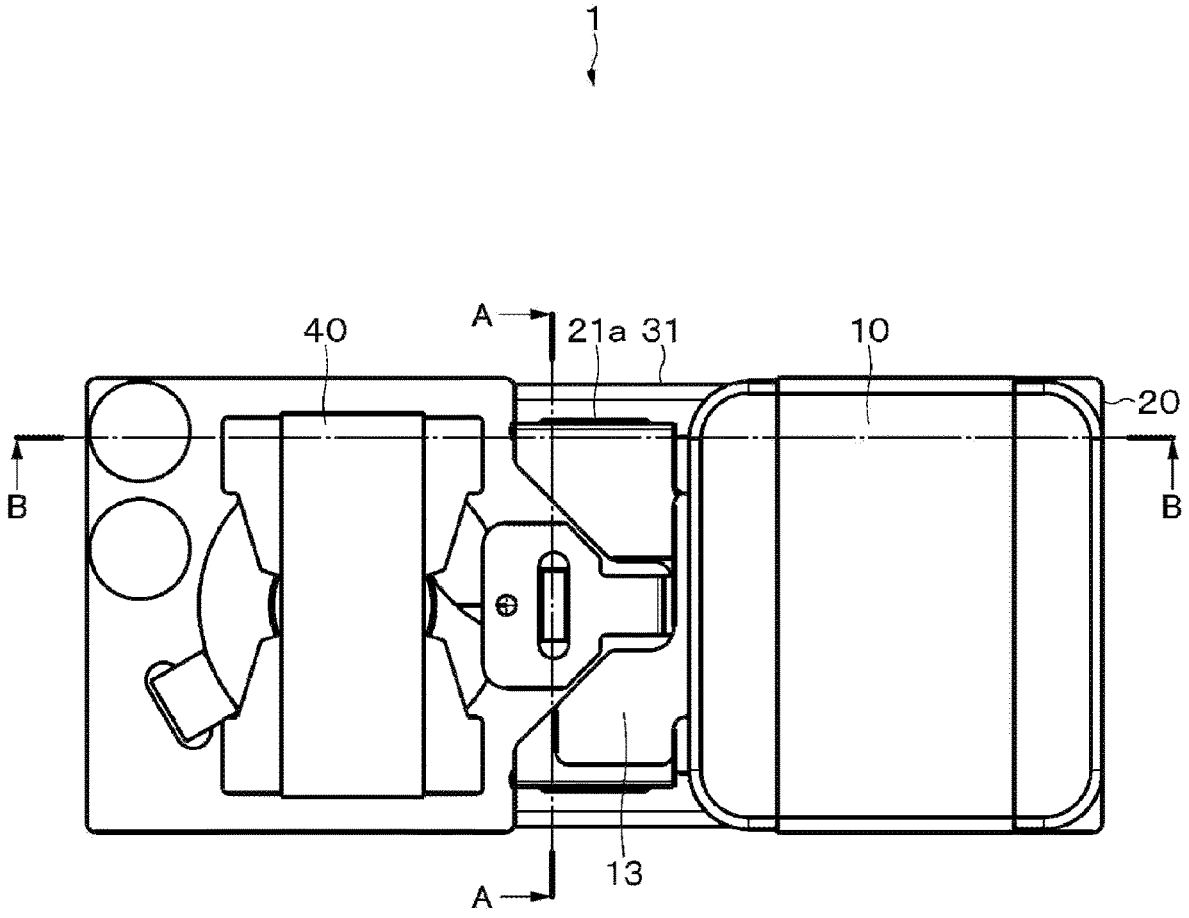
FIG. 12 is a plan view of the power supply unit according to the embodiment of the present disclosure.
Figure 13A:
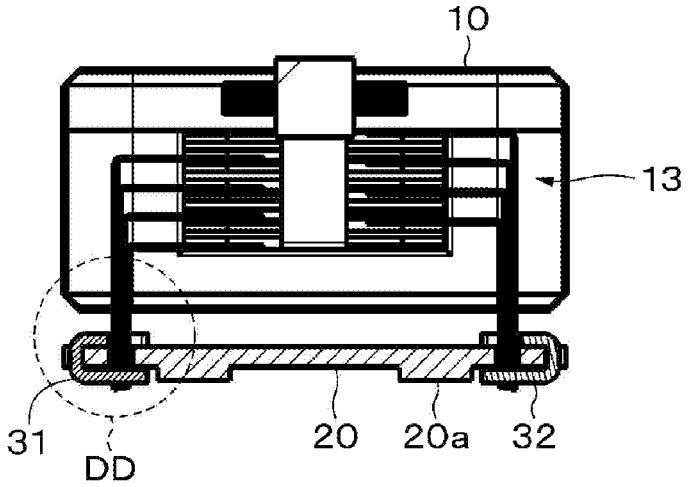
FIGS. 13A and 13B are views illustrating end surfaces taken along a cutting line A-A in FIG. 12.
Figure 13B:
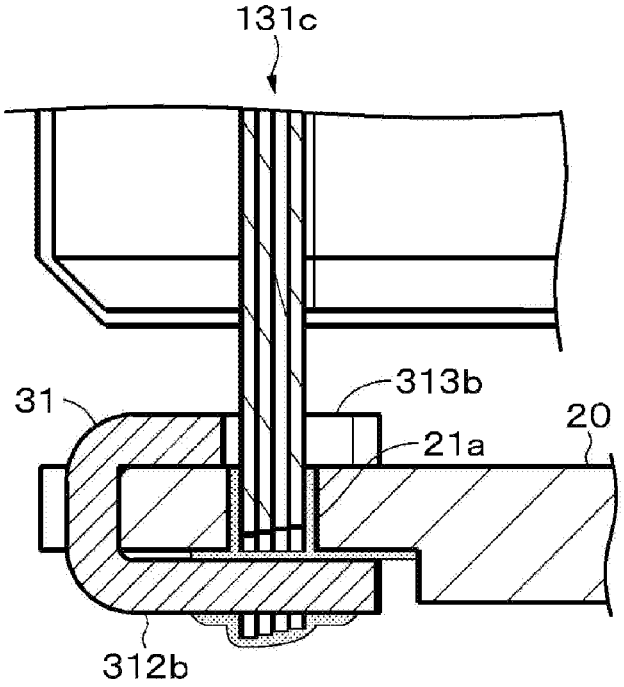
Figure 14A:
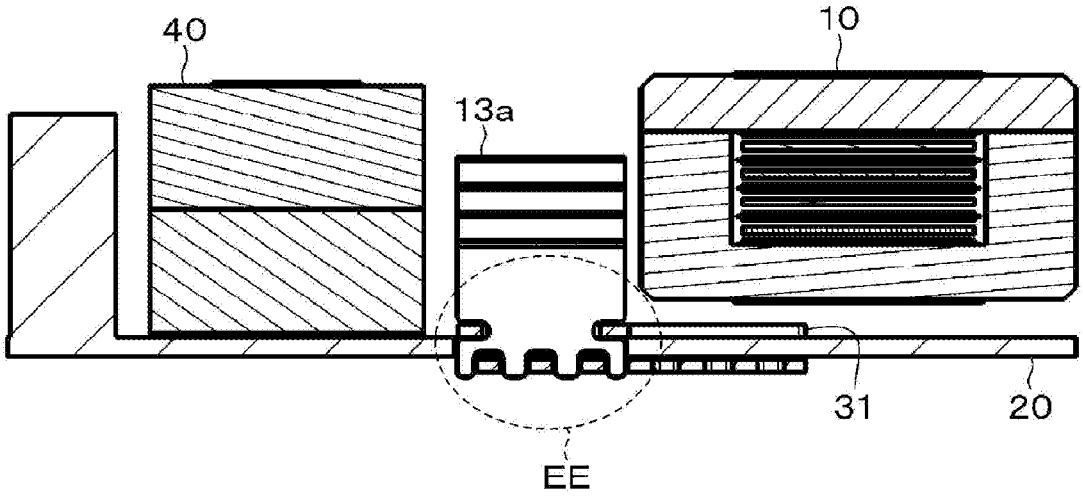
FIGS. 14A and 14B are views illustrating end surfaces taken along a cutting line B-B in FIG. 12.
Figure 14B:
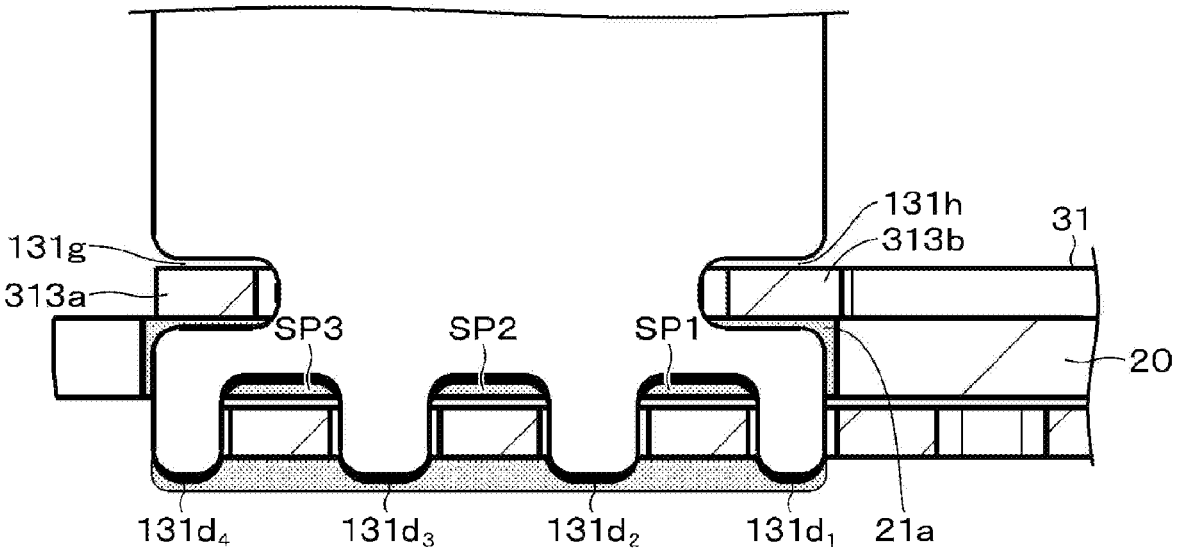

Next, a bonding structure in the embodiment of the present disclosure will be described with reference to FIGS. 12 to 14. FIG. 12 is a plan view of the power supply unit 1, FIG. 13A is a view illustrating an end surface taken along a cutting line A-A in FIG. 12, and FIG. 13B is an enlarged view of a portion surrounded by a dotted line and denoted by a reference sign DD in FIG. 13A. FIG. 14A is a view illustrating an end surface taken along a cutting line B-B in FIG. 12, and FIG. 14B is an enlarged view of a portion surrounded by a dotted line and denoted by a reference sign EE in FIG. 14A. Note that the cutting lines A-A and B-B respectively pass through a short direction and a longitudinal direction of the through hole 21*a*. Further, in FIGS. 13B and 14B, the solder is illustrated with dotted hatching.

As illustrated in FIGS. 13A and 14A, the pin parts 131*d* of the four first coil parts 13*a* and the pin parts 132*d* of the four second coil parts 13*b* are respectively inserted into the through holes 21*a* and 21*b* of the substrate 20. Then, after the bus bars 31 and 32 are mounted, soldering is performed from the side of the back surface 20*a* of the substrate 20, as illustrated in FIG. 13B.

As illustrated in FIG. 14B, when soldering is performed from the side of the back surface 20*a* of the substrate 20, the solder flows not only onto a peripheral surface (a surface exposed to the outside) of the pin part 131*d* but also into each of the spaces SP1, SP2, and SP3.

As an assumed technology (not a conventional technology), a configuration in which the pin part is not provided at the tip of the leg part of the first coil part can be considered. However, in this configuration, while the first coil part in a first layer and the first coil part in a fourth layer, which are located on front surface sides, can be solder-bonded over a large area by performing soldering to the peripheral surface, inner layer portions in a second layer and a third layer are bonded only at the peripheral surface of the pin part, and accordingly, bonding strength cannot be improved.

However, by forming solder inflow paths (for example, the spaces SP1, SP2, and SP3) along the arrangement direction of the plurality of leg parts as in the above-described solder-bonding structure, it is possible to allow the solder to flow not only onto the peripheral surface of the pin part but also inside the pin part (the surfaces between the pins). With this arrangement, it is possible to stabilize a solder-bonding state, and also to stabilize an electrical bonding state. Further, since a solder-bonding area can be increased, and a stable and uniform solder-bonding state can be achieved, loss in a solder-bonding portion can be reduced. Therefore, high efficiency can be achieved. Further, since the bonding state of the solder is stabilized, vibration resistance and impact resistance can be improved, and reliability in a long-term operation under a severe use environment (a temperature cycle and the like) can be secured.

Further, with the above-described solder-bonding structure, an entire solder-bonding portion can be sufficiently preheated, and therefore, variations in the bonding state of the solder and a failure in solder-bonding can be prevented. Further, since there is no need to change a conventional process, production cost is not increased.

Note that, although electrical bonding can be performed by mechanical contact fixation using screws, nuts, or the like, for example, high efficiency is hindered by increase in contact resistance between the coil parts and between the screws and nut parts, and additional components necessary for mechanical fixation such as the screws and the nuts are required. Thus, there is a problem that a structure becomes large-sized and cost increases due to increase in the number of components. However, in the above-described embodiment, these problems do not occur since no new components are required.

2. Application Example

The technology according to the present disclosure is applicable to a variety of products. For example, the present disclosure can be implemented as a power supply device in which the power supply unit according to the above-described embodiment is connected to a power supply part or the like. Moreover, such a power supply device may be implemented as a device mounted on any type of moving body such as an automobile, an electric vehicle, a hybrid electric vehicle, a motorcycle, a bicycle, a personal mobility, an airplane, a drone, a ship, a robot, a construction machine, or an agricultural machine (a tractor).

Figure 15:
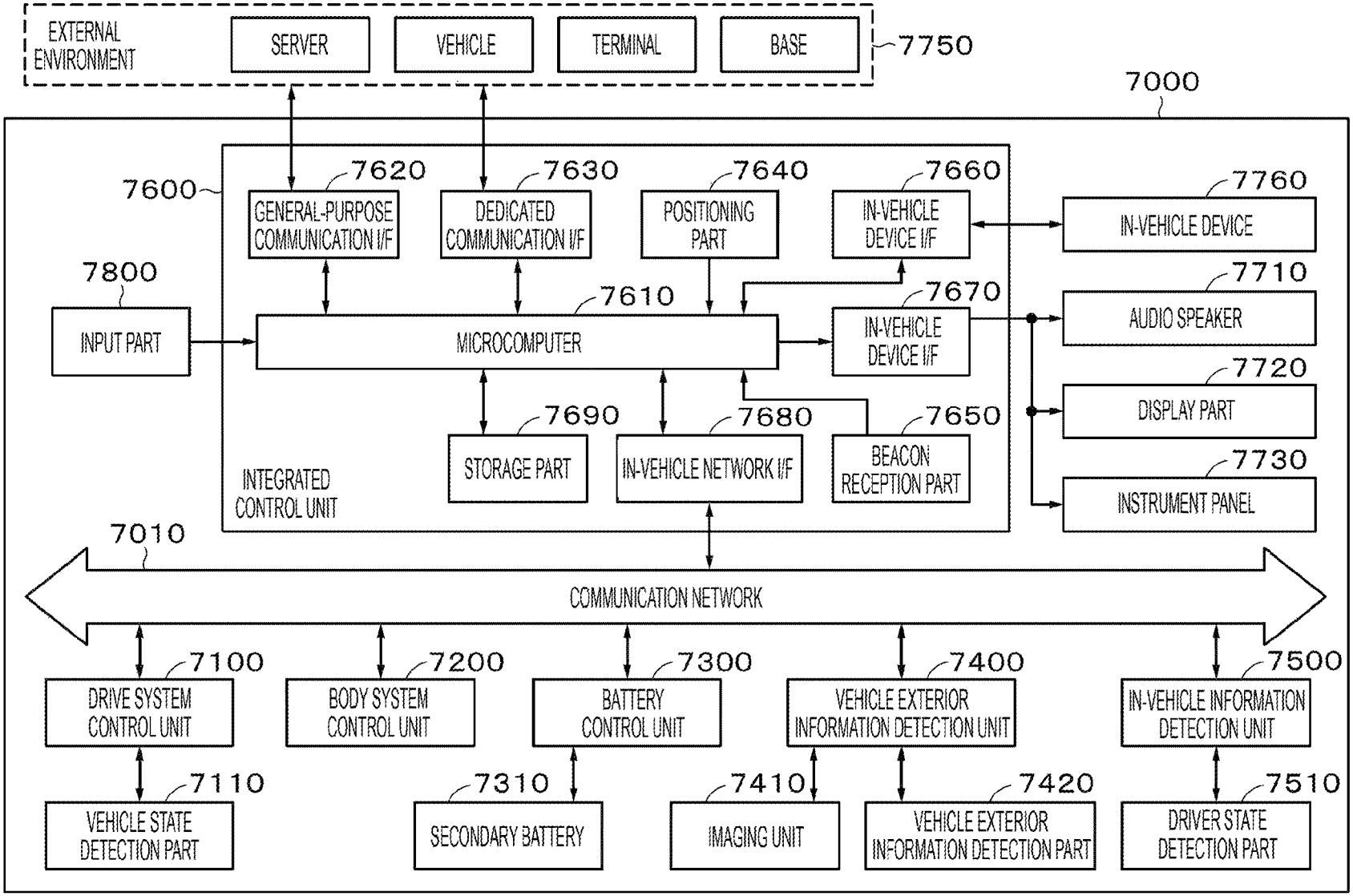
FIG. 15 is a block diagram for describing an application example.

FIG. 15 is a block diagram illustrating a schematic configuration example of a vehicle control system 7000 as an example of a moving body control system to which the technology according to the present disclosure can be applied. The vehicle control system 7000 includes a plurality of electronic control units connected via a communication network 7010. In an example illustrated in FIG. 15, the vehicle control system 7000 includes a drive system control unit 7100, a body system control unit 7200, a battery control unit 7300, a vehicle exterior information detection unit 7400, an in-vehicle information detection unit 7500, and an integrated control unit 7600. The communication network 7010, which connects the plurality of control units, may be an in-vehicle communication network such as a controller area network (CAN), a local interconnect network (LIN), a local area network (LAN), or FlexRay (registered trademark) that conforms to an arbitrary standard, for example.

Each control unit includes a microcomputer that performs operation processing in accordance with various programs, a storage part that stores the programs, parameters used for various operations, or the like executed by the microcomputer, and a drive circuit that drives devices subjected to various types of control. Each control unit includes a network I/F that performs communication with other control units via the communication network 7010, and a communication I/F that performs communication with devices, sensors, or the like inside and outside a vehicle by wired communication or wireless communication. FIG. 15 illustrates a microcomputer 7610, a general-purpose communication I/F 7620, a dedicated communication I/F 7630, a positioning part 7640, a beacon reception part 7650, an in-vehicle device I/F 7660, a sound/image output part 7670, an in-vehicle network I/F 7680, and a storage part 7690, as a functional configuration of the integrated control unit 7600. Each of the other control units similarly includes a microcomputer, a communication I/F, a storage part, and the like.

The drive system control unit 7100 controls operation of devices related to a drive system of a vehicle in accordance with various programs. For example, the drive system control unit 7100 functions as a control device for a drive force generation device such as an internal combustion engine or a drive motor that generates a drive force of the vehicle, a drive force transmission mechanism that transmits the drive force to wheels, a steering mechanism that adjusts a steering angle of the vehicle, a braking device that generates a braking force of the vehicle, and the like. The drive system control unit 7100 may have a function of a control device for an antilock brake system (ABS), an electronic stability control (ESC) or the like.

The drive system control unit 7100 is connected to a vehicle state detection part 7110. The vehicle state detection part 7110 includes, for example, at least one of a gyro sensor that detects an angular velocity of an axial rotation motion of a vehicle body, an acceleration sensor that detects acceleration of the vehicle, or a sensor that detects an operation amount of an accelerator pedal, an operation amount of a brake pedal, a steering angle of a steering wheel, an engine speed, a rotation speed of the wheel, or the like. The drive system control unit 7100 uses a signal input from the vehicle state detection part 7110 to perform operation processing, and controls an internal combustion engine, a drive motor, an electric power steering device, a brake device, or the like.

The body system control unit 7200 controls operation of various devices equipped to the vehicle body in accordance with various programs. For example, the body system control unit 7200 functions as a control device for a keyless entry system, a smart key system, a power window device, or various lamps such as a head lamp, a back lamp, a brake lamp, a blinker, or a fog lamp. In this case, the body system control unit 7200 can receive radio waves transmitted from a portable machine that serves instead of a key or signals of various switches. The body system control unit 7200 receives input of these radio waves or signals, and controls a vehicle door lock device, a power window device, a lamp, or the like.

The battery control unit 7300 controls a secondary battery 7310 serving as a power supply source of the drive motor in accordance with various programs. For example, the battery control unit 7300 receives information such as a battery temperature, a battery output voltage, or a remaining battery capacity from a battery device including the secondary battery 7310. The battery control unit 7300 uses these signals to perform operation processing, and performs temperature adjustment control on the secondary battery 7310 or control on a cooling device or the like included in the battery device.

The vehicle exterior information detection unit 7400 detects information regarding the outside of the vehicle mounting the vehicle control system 7000. For example, the vehicle exterior information detection unit 7400 is connected to at least one of an imaging part 7410 or a vehicle exterior information detection part 7420. The imaging part 7410 includes at least one of a time of flight (ToF) camera, a stereo camera, a monocular camera, an infrared camera, or other cameras. The vehicle exterior information detection part 7420 includes, for example, at least one of an environmental sensor that detects current weather, or an ambient information detection sensor that detects another vehicle, an obstacle, a pedestrian, or the like around the vehicle mounting the vehicle control system 7000.

The environmental sensor may be, for example, at least one of a raindrop sensor that detects rainy weather, a fog sensor that detects fog, a sunshine sensor that detects a degree of sunshine, or a snow sensor that detects a snowfall. The ambient information detection sensor may be at least one of an ultrasonic sensor, a radar device, or a light detection and ranging, laser imaging detection and ranging (LIDAR) device. These imaging part 7410 and vehicle exterior information detection part 7420 may be installed as independent sensors or devices, or as a device into which a plurality of sensors or devices is integrated.

Figure 16:
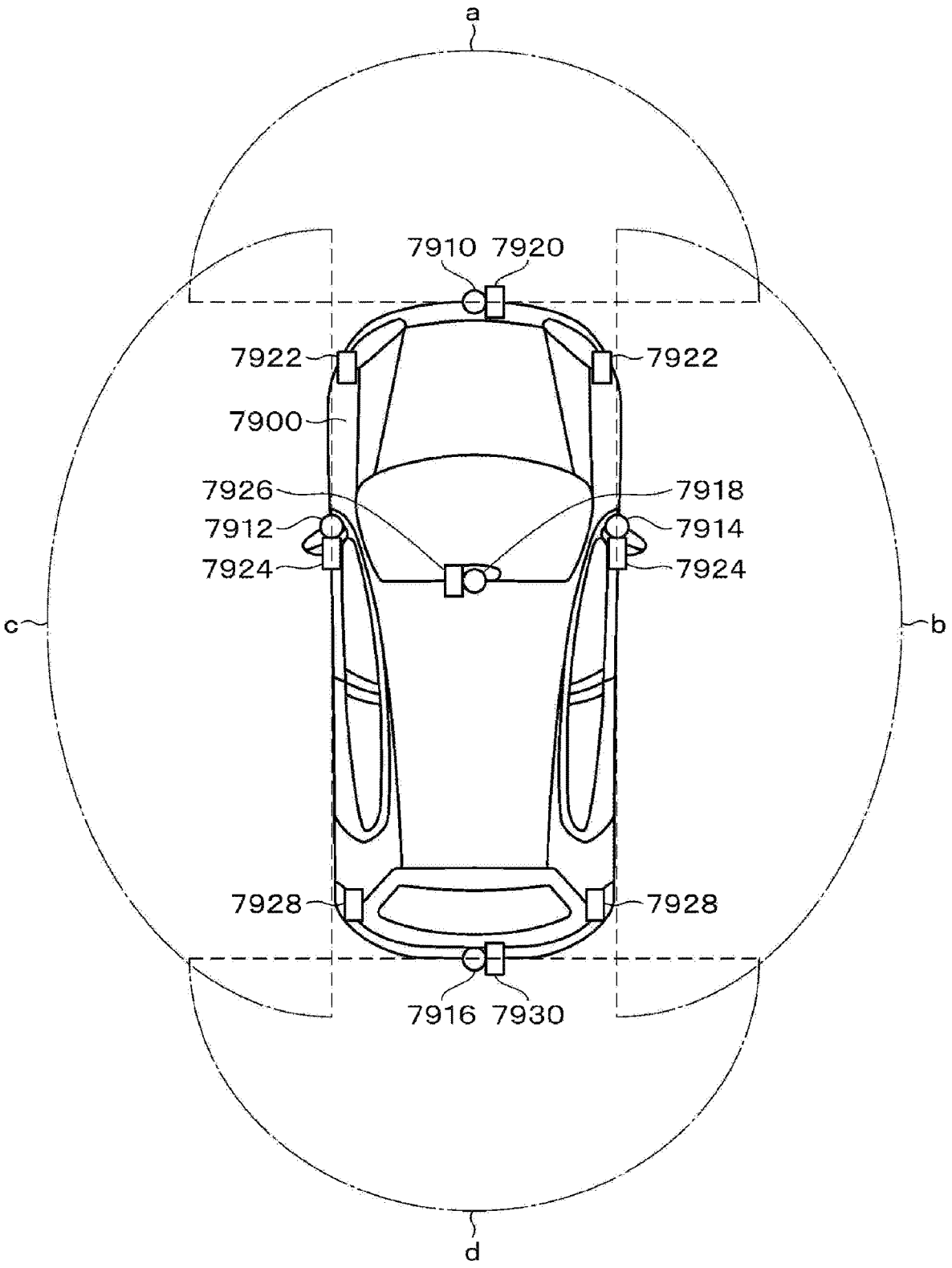
FIG. 16 is a view for describing the application example.

Here, FIG. 16 illustrates an example of installation positions of the imaging part 7410 and the vehicle exterior information detection part 7420. Imaging parts 7910, 7912, 7914, 7916, and 7918 are provided, for example, to at least one of a front nose, a side mirror, a rear bumper, a back door, or an upper part of a windshield in a vehicle compartment of a vehicle 7900. The imaging part 7910 provided to the front nose and the imaging part 7918 provided in the upper part of the windshield in the vehicle compartment mainly acquire images of areas ahead of the vehicle 7900. The imaging parts 7912 and 7914 provided to the side mirrors mainly acquire images of areas on sides of the vehicle 7900. The imaging part 7916 provided to the rear bumper or the back door mainly acquires images of an area behind the vehicle 7900. The imaging part 7918 provided in the upper part of the windshield in the vehicle compartment is used mainly to detect a preceding vehicle, a pedestrian, an obstacle, a traffic light, a traffic sign, a lane, or the like.

Note that FIG. 16 illustrates an example of respective imaging ranges of the imaging parts 7910, 7912, 7914, and 7916. An imaging range a represents an imaging range of the imaging part 7910 provided to the front nose, imaging ranges b and c respectively represent imaging ranges of the imaging parts 7912 and 7914 provided to the side mirrors, and an imaging range d represents an imaging range of the imaging part 7916 provided to the rear bumper or the back door. For example, by overlaying image data imaged by the imaging parts 7910, 7912, 7914, and 7916, an overhead image seen from above the vehicle 7900 is obtained.

Vehicle exterior information detection parts 7920, 7922, 7924, 7926, 7928, and 7930 provided to a front, a rear, sides, corners, and the upper part of the windshield in the vehicle compartment of the vehicle 7900 may be, for example, ultrasonic sensors or radar devices. The vehicle exterior information detection parts 7920, 7926, and 7930 provided to the front nose, the rear bumper, the back door, and the upper part of the windshield in the vehicle compartment of the vehicle 7900 may be, for example, LIDAR devices. These vehicle exterior information detection parts 7920 to 7930 are used mainly to detect a preceding vehicle, a pedestrian, an obstacle, or the like.

The description will be continued with reference to FIG. 15 again. The vehicle exterior information detection unit 7400 causes the imaging part 7410 to image images of the outside of the vehicle, and receives the imaged image data. Further, the vehicle exterior information detection unit 7400 receives detection information from the connected vehicle exterior information detection part 7420. In a case where the vehicle exterior information detection part 7420 is an ultrasonic sensor, a radar device, or a LIDAR device, the vehicle exterior information detection unit 7400 causes ultrasound, electromagnetic waves, or the like to be transmitted, and receives information of received reflected waves. The vehicle exterior information detection unit 7400 may perform detection processing of an object such as a person, an automobile, an obstacle, a traffic sign, or a letter on a road, or a distance detection processing on the basis of the received information. The vehicle exterior information detection unit 7400 may perform environment recognition processing of recognizing a rainfall, fog, a road condition, or the like on the basis of the received information. The vehicle exterior information detection unit 7400 may compute a distance to an object outside the vehicle on the basis of the received information.

Further, the vehicle exterior information detection unit 7400 may perform image recognition processing of recognizing a person, an automobile, an obstacle, a traffic sign, a letter on a road, or the like, or a distance detection processing on the basis of the received image data. The vehicle exterior information detection unit 7400 may perform distortion correction processing, positioning processing, or the like on the received image data, and combine image data imaged by a different imaging part 7410 to generate an overhead image or a panoramic image. The vehicle exterior information detection unit 7400 may use the image data imaged by the different imaging part 7410 to perform viewpoint conversion processing.

The in-vehicle information detection unit 7500 detects information regarding the inside of the vehicle. The in-vehicle information detection unit 7500 is connected, for example, to a driver state detection part 7510 that detects a state of a driver. The driver state detection part 7510 may include a camera that images the driver, a biological sensor that detects biological information of the driver, a microphone that picks up a sound in the vehicle compartment, or the like. The biological sensor is provided, for example, to a seating surface or the steering wheel, and detects the biological information of a passenger sitting on a seat or the driver gripping the steering wheel. The in-vehicle information detection unit 7500 may compute a degree of tiredness or a degree of concentration of the driver or determine whether or not the driver have a doze, on the basis of the detection information input from the driver state detection part 7510. The in-vehicle information detection unit 7500 may perform processing such as noise cancelling processing on a picked-up sound signal.

The integrated control unit 7600 controls an overall operation inside the vehicle control system 7000 in accordance with various programs. The integrated control unit 7600 is connected to an input part 7800. The input part 7800 is implemented by a device on which an input operation can be performed by a passenger, for example, a touch panel, a button, a microphone, a switch, or a lever. The integrated control unit 7600 may receive data obtained by sound recognition on the sound input by the microphone. For example, the input part 7800 may be a remote control device that uses infrared light or other radio waves, or an external connection device such as a mobile phone or a personal digital assistant (PDA) corresponding to operation of the vehicle control system 7000. The input part 7800 may be, for example, a camera, and in that case, the passenger can input information through gesture. Alternatively, data obtained by detection of a movement of a wearable device worn by the passenger may be input. Moreover, the input part 7800 may include, for example, an input control circuit that generates an input signal on the basis of the information input by the passenger or the like using the above-described input part 7800, and outputs the generated input signal to the integrated control unit 7600. By operating the input part 7800, the passenger or the like inputs various data to the vehicle control system 7000 and instructs the vehicle control system 7000 to perform processing operation.

The storage part 7690 may include a read only memory (ROM) that stores various programs to be executed by the microcomputer, and a random access memory (RAM) that stores various parameters, operation results, sensor values, or the like. Further, the storage part 7690 may be implemented by a magnetic storage device such as a hard disk drive (HDD), a semiconductor storage device, an optical storage device, a magneto-optical storage device, or the like.

The general-purpose communication I/F 7620 is a versatile communication I/F that mediates communication between a variety of devices in an external environment 7750. The general-purpose communication I/F 7620 may implement a cellular communication protocol such as global system of mobile communications (GSM), WiMAX, long term evolution (LTE) or LTE-Advanced (LTE-A), or other wireless communication protocols such as a wireless LAN (also referred to as Wi-Fi (registered trademark)) or Bluetooth (registered trademark). The general-purpose communication I/F 7620 may be connected to a device (for example, an application server or a control server) on an external network (for example, the Internet, a cloud network, or a network specific to a service provider), for example, via a base station or an access point. Further, the general-purpose communication I/F 7620 may be connected to a terminal (for example, a terminal of a driver, a pedestrian, or a store, or a machine type communication (MTC) terminal) in the vicinity of the vehicle, for example, using peer-to-peer (P2P) technology.

The dedicated communication I/F 7630 is a communication I/F that supports a communication protocol defined for the purpose of use for vehicles. For example, the dedicated communication I/F 7630 may implement a standard protocol such as wireless access in vehicle environment (WAVE), which is a combination of IEEE802.11p for a lower layer and IEEE1609 for an upper layer, dedicated short range communications (DSRC), or a cellular communication protocol. The dedicated communication I/F 7630 typically carries out V2X communication, which is a concept including one or more of vehicle-to-vehicle communication, vehicle-to-infrastructure communication, vehicle-to-home communication, and vehicle-to-pedestrian communication.

The positioning part 7640 receives, for example, global navigation satellite system (GNSS) signals (for example, global positioning system (GPS) signals from a GPS satellite) from a GNSS satellite to execute positioning, and generates position information including latitude, longitude, and altitude of the vehicle. Note that the positioning part 7640 may identify a current position by exchange of signals with a wireless access point, or acquire the position information from a terminal such as a mobile phone, a PHS, or a smartphone that has a positioning function.

The beacon reception part 7650 receives radio waves or electromagnetic waves, for example, from a wireless station installed on a road, and acquires information such as the current position, traffic congestion, closed roads, or necessary time. Note that a function of the beacon reception part 7650 may be included in the above-described dedicated communication I/F 7630.

The in-vehicle device I/F 7660 is a communication interface that mediates connections between the microcomputer 7610 and a variety of in-vehicle devices 7760 in the vehicle. The in-vehicle device I/F 7660 may use a wireless communication protocol such as a wireless LAN, Bluetooth (registered trademark), near field communication (NFC), or a wireless USB (WUSB) to establish a wireless connection. Further, the in-vehicle device I/F 7660 may establish a wired connection such as a universal serial bus (USB), a high-definition multimedia interface (HDMI), or a mobile high-definition link (MHL), via a connection terminal which is not illustrated (and a cable if necessary). The in-vehicle devices 7760 may include, for example, at least one of a mobile device or a wearable device of a passenger, or an information device carried into or attached to the vehicle. Further, the in-vehicle devices 7760 may include a navigation device that performs a route search to an arbitrary destination. The in-vehicle device I/F 7660 exchanges control signals or data signals with these in-vehicle devices 7760.

The in-vehicle network I/F 7680 is an interface that mediates communication between the microcomputer 7610 and the communication network 7010. The in-vehicle network I/F 7680 transmits and receives signals or the like in compliance with a predetermined protocol supported by the communication network 7010.

The microcomputer 7610 of the integrated control unit 7600 controls the vehicle control system 7000 in accordance with various programs on the basis of information acquired via at least one of the general-purpose communication I/F 7620, the dedicated communication I/F 7630, the positioning part 7640, the beacon reception part 7650, the in-vehicle device I/F 7660, or the in-vehicle network I/F 7680. For example, the microcomputer 7610 may calculate a control target value of the drive force generation device, the steering mechanism, or the braking device on the basis of acquired information regarding the inside and outside of the vehicle, and output a control instruction to the drive system control unit 7100. For example, the microcomputer 7610 may perform cooperative control for the purpose of implementing functions of an advanced driver assistance system (ADAS) including vehicle collision avoidance or impact reduction, follow-up driving based on an inter-vehicle distance, constant vehicle speed driving, vehicle collision warning, vehicle lane departure warning, or the like. Further, the microcomputer 7610 may perform cooperative control for the purpose of automatic driving or the like for autonomous travel without depending on an operation of a driver by controlling the drive force generation device, the steering mechanism, the braking device, or the like on the basis of acquired information regarding surroundings of the vehicle.

The microcomputer 7610 may create local map information including information regarding surroundings of the current position of the vehicle on by generating three-dimensional distance information between the vehicle and surrounding structures, objects such as a person, or the like on the basis of information acquired via at least one of the general-purpose communication I/F 7620, the dedicated communication I/F 7630, the positioning part 7640, the beacon reception part 7650, the in-vehicle device I/F 7660, or the in-vehicle network I/F 7680. Further, the microcomputer 7610 may predict danger such as vehicle collisions, approaching pedestrians or the like, or entry to closed roads on the basis of acquired information, and generate a warning signal. The warning signal may be, for example, a signal used to generate a warning sound or turn on a warning lamp.

The sound/image output part 7670 transmits an output signal of at least one of a sound or an image to an output device capable of visually or aurally notifying a passenger of the vehicle or the outside of the vehicle of information. In an example of FIG. 15, an audio speaker 7710, a display part 7720, and an instrument panel 7730 are exemplified as the output device. The display part 7720 may include, for example, at least one of an onboard display or a head-up display. The display part 7720 may have an augmented reality (AR) display function. The output device may be another device other than these devices such as a headphone, a wearable device like a spectacular display worn by a passenger, a projector, or a lamp. In a case where the output device is a display device, the display device visually displays a result obtained by various kinds of processing performed by the microcomputer 7610 or information received from another control unit in a variety of forms such as text, images, tables, or graphs. Further, in a case where the output device is a sound output device, the sound output device converts audio signals including reproduced sound data, acoustic data, or the like into analog signals, and aurally outputs the analog signals.

Note that, in the example illustrated in FIG. 15, at least two control units connected via the communication network 7010 may be integrated into one control unit. Alternatively, the individual control units may include a plurality of control units. Moreover, the vehicle control system 7000 may include another control unit that is not illustrated. Further, in the above description, a part or the whole of the functions executed by any of the control units may be executed by another control unit. That is, predetermined operation processing may be performed by any of the control units, as long as information is transmitted and received via the communication network 7010. Similarly, a sensor or a device connected to any of the control units may be connected to another control unit, and the plurality of control units may transmit and receive detection information to and from each other via the communication network 7010.

In the vehicle control system 7000 described above, the power supply unit 1 according to the present embodiment described with reference to FIGS. 1 to 14 can be applied to a part of the secondary battery 7310 of the application example illustrated in FIG. 15.

3. Modification

Hereinabove, specific description has been given of the embodiment and the like of the present disclosure. However, the content of the present disclosure is not limited to the above-described embodiment, and various modifications based on a technical concept of the present disclosure can be made.

Modification 1

Figure 17A:
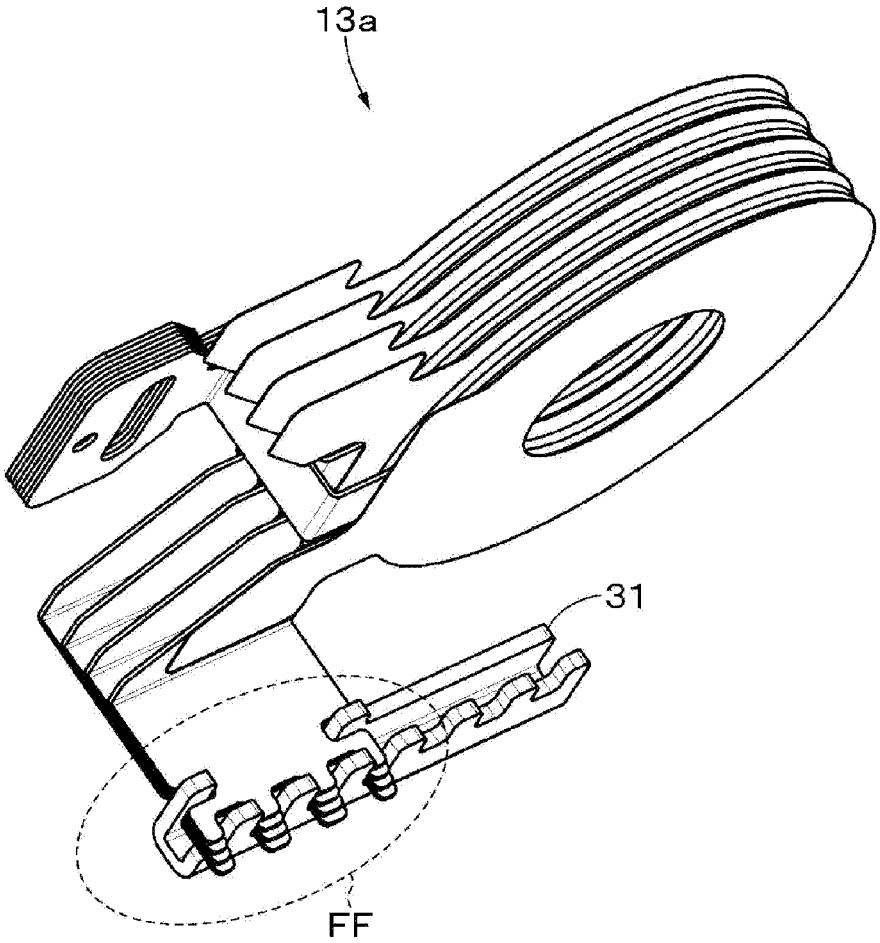
FIGS. 17A and 17B are views for describing a modification.
Figure 17B:
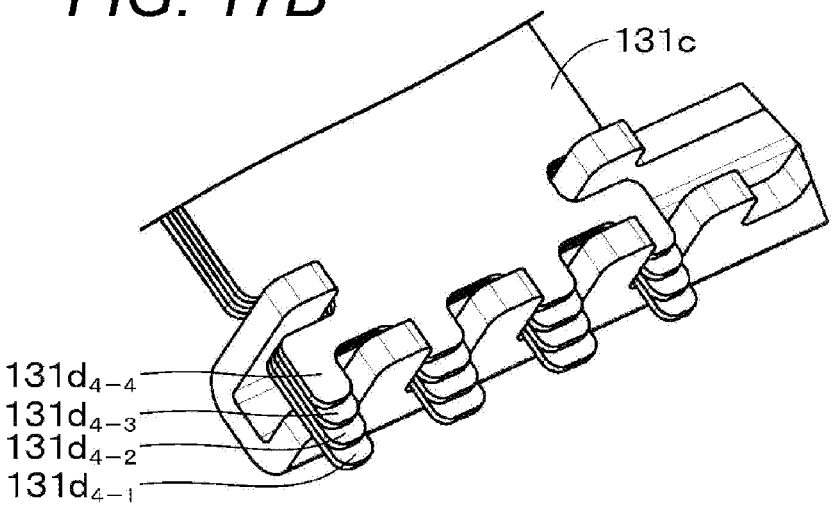

FIG. 17 is a view for describing Modification 1. FIG. 17A is a view illustrating an outline of Modification 1, and FIG. 17B is an enlarged view of a portion surrounded by a dotted line and denoted by a reference sign FF in FIG. 17A. As illustrated in FIG. 17A, a bus bar 31 is attached to first coil parts 13*a* of a secondary side coil 13. Shapes of pin parts 131*d* of the four first coil parts 13*a* (specifically, lengths of pins constituting the pin parts 131*d* (lengths in a vertical direction after assembly)) may be different from one another.

For example, four pins included in each of the four first coil parts 13*a* and arranged at corresponding positions are assumed to be a pin 131$d_4$-1, a pin 131$d_4$-2, a pin 131$d_4$-3, and a pin 131$d_4$-4. For example, the lengths of the pins are set so that the following expression (1) holds.

$$\text{pin } 131d_4\text{-}1 > \text{pin } 131d_4\text{-}2 > \text{pin } 131d_4\text{-}3 > \text{pin } 131d_4\text{-}4 \quad (1)$$

Lengths of pins at other portions are set in a similar way.

With this arrangement, as illustrated in FIGS. 17A and 17B, a step-shaped (stepped) portion includes the four pins. For example, the step-shaped portion is formed along a direction substantially orthogonal to an arrangement direction of leg parts 131*c*. When soldering is performed, not only a peripheral surface but also the step-shaped portion is soldered. Therefore, a solder-bonding area can be increased, and an effect similar to that in the above-described embodiment can be obtained.

Note that, in the present Modification 1, it is not necessary that the lengths of all the pins are different, and there may be portions having the same length. For example, the lengths of the pins may be set so that the following expression (2) holds.

$$\text{pin } 131d_4\text{-}1 = \text{pin } 131d_4\text{-}4 > \text{pin } 131d_4\text{-}2 = \text{pin } 131d_4\text{-}3 \quad (2)$$

With this arrangement, kinds of the lengths of the pins can be reduced to two kinds.

Note that the present Modification 1 can be similarly applied to a pin part 132*d* of a second coil part 13*b*.

Modification 2

Figure 18A:
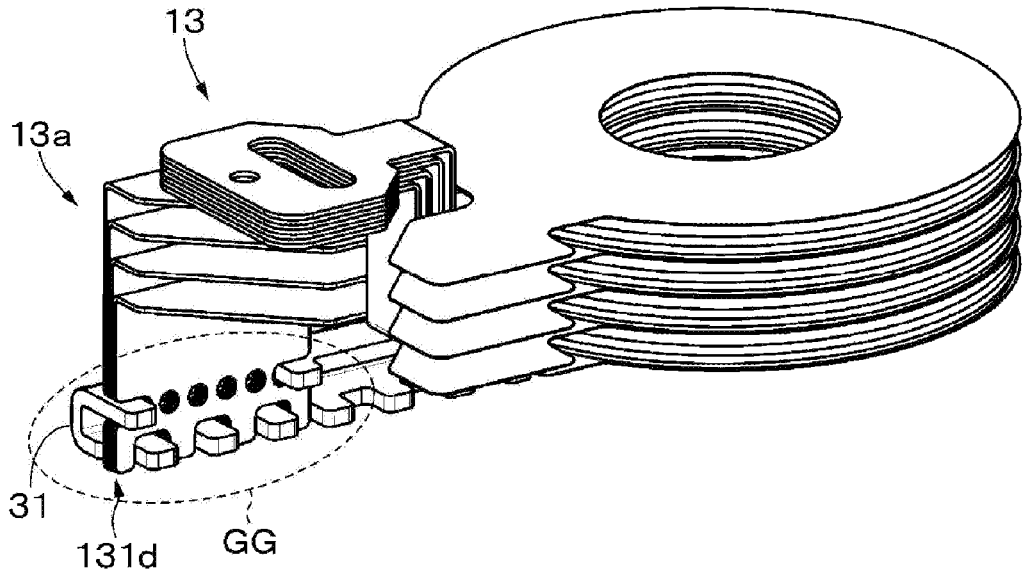
FIGS. 18A and 18B are views for describing a modification.
Figure 18B:
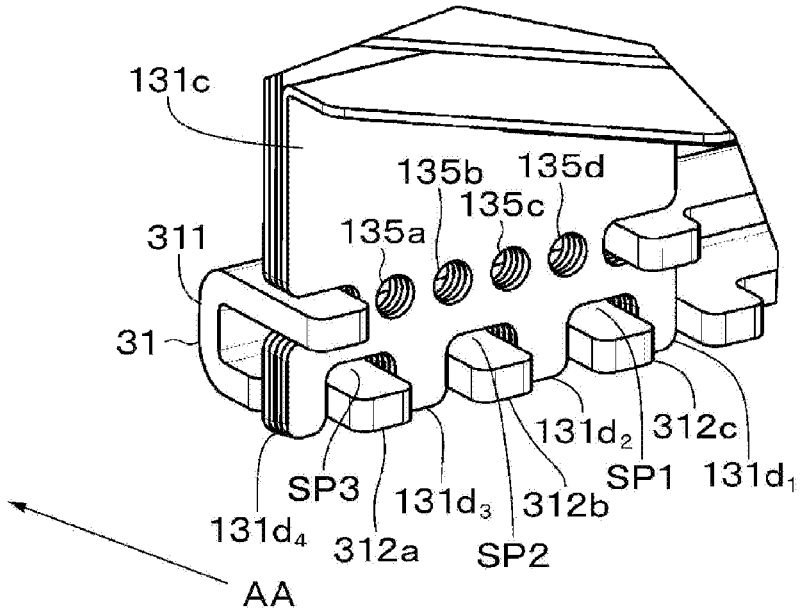

FIG. 18 is a view for describing Modification 2. FIG. 18A is a view illustrating an outline of Modification 2, and FIG. 18B is an enlarged view of a portion surrounded by a dotted line and denoted by a reference sign GG in FIG. 18A. As illustrated in FIG. 18A, a bus bar 31 is attached to first coil parts 13*a* of a secondary side coil 13.

A circular hole 135 is formed in the vicinity of a tip of a leg part 131*c* (in the vicinity of a pin part 131*d*) of each of the four first coil parts 13*a*. In the present Modification 2, four holes 135*a*, 135*b*, 135*c*, and 135*d* are formed. Note that the number of the holes may be one, or a plurality of numbers other than four.

Positions of the holes 135 formed in the leg parts 131*c* are substantially the same. With this arrangement, as illustrated in FIG. 18B, in a case where the four first coil parts 13*a* are assembled, four through holes as inflow paths of solder along an arrangement direction of the leg parts 131*c* are formed. By the solder flowing into these through holes, a solder-bonding area can be enlarged, and therefore an effect similar to that in the embodiment can be obtained. Note that Modification 2 may include the hole 135 only, without a pin part 131*d*. Further, the present Modification 2 can be similarly applied to a second coil part 13*b*.

Modification 3

Figure 19A:
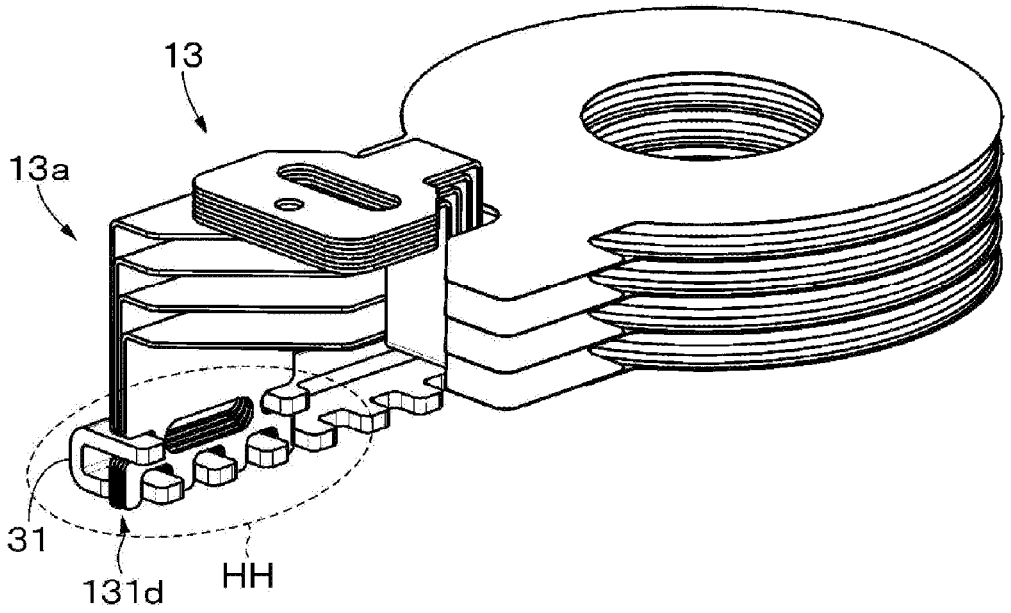
FIGS. 19A and 19B are views for describing a modification.
Figure 19B:
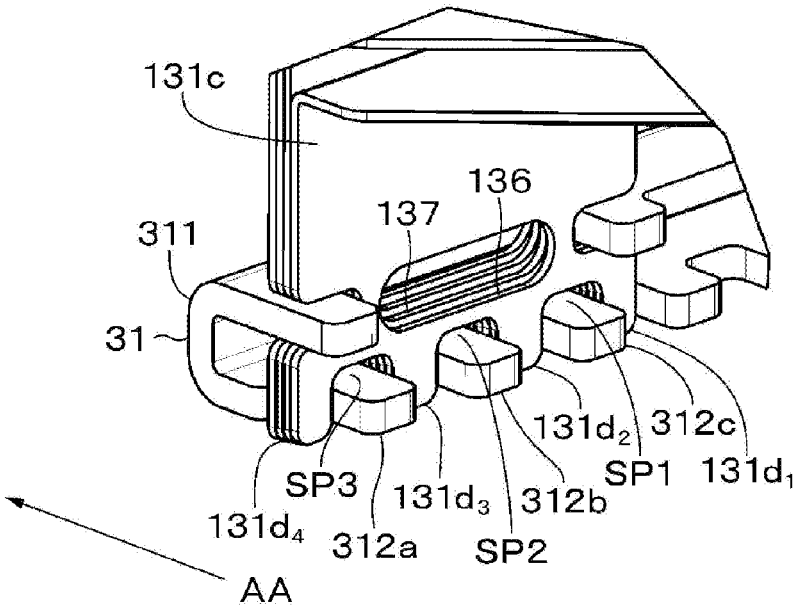

FIG. 19 is a view for describing Modification 3. FIG. 19A is a view illustrating an outline of Modification 3, and FIG. 19B is an enlarged view of a portion surrounded by a dotted line and denoted by a reference sign HH in FIG. 19A. As illustrated in FIG. 19A, a bus bar 31 is attached to first coil parts 13*a* of a secondary side coil 13.

An oval hole 136 as an inflow path of solder is formed in the vicinity of a tip of a leg part 131*c* (in the vicinity of a pin part 131*d*) of each of the four first coil parts 13*a*. In the present Modification 3, sizes of shapes of the four holes 136 are set to be different. With this configuration, a step-shaped portion 137 can be formed along an arrangement direction of the four leg parts 131*c*. The step-shaped portion 137 is also soldered. Therefore, a solder-bonding area can be increased, and an effect similar to that in the embodiment can be obtained. Note that the step-shaped portion 137 may be formed by appropriately shifting positions where the holes 136 are formed, or the step-shaped portion 137 may be formed by making both the positions where the holes 136 are formed and the sizes of the holes 136 different.

Other Modifications

In the above-described embodiment, the configuration using a bus bar has been described. In recent years, thickness of a circuit pattern on a substrate has become thinner. A thickness of a circuit pattern is generally about 35 μm to 100 μm. Even in a case where the number of coil layers in a transformer 10 is increased to increase an effective conductor area of a coil part or the like, the effective conductor area of a substrate circuit pattern part is too small to ensure a sufficient conductor area, and accordingly, loss in the circuit pattern part is increased. As a result, conversion efficiency is reduced. By using a bus bar, a conductor part of the circuit pattern can be complemented, and a circuit impedance can be lowered even in a case where a large current is applied to a circuit. With this arrangement, loss in a circuit part can be minimized and high efficiency can be achieved. As described above, it is possible to cope with a case where a large current is applied by using the bus bar. However, the bus bar may not be used depending on an application amount of current, a use of a power supply unit 1, or the like.

A shape of a secondary side coil can be appropriately changed. For example, a shape of a base part may be a rectangular shape or a polygonal shape instead of a disc shape, and a coupling part may not be provided.

A shape of the bus bar can be appropriately changed. For example, the shape of the bus bar may include only a configuration attached to a back surface side of a substrate, without a support part. In this case, a configuration corresponding to the support part may be formed in first and second coil parts. For example, protruded parts or the like may be formed on the first and second coil parts, and positioning of the first and second coil parts may be performed by engagement and the like of the protruded parts and the substrate.

A multilayered coil part as a solder-bonding portion may be integrated beforehand by welding or caulking. With this arrangement, a cost can be reduced as a result of reduction in the number of working steps.

The configurations, methods, processes, shapes, materials, numerical values, and the like in the above-described embodiment are merely examples, and different configurations, methods, processes, shapes, materials, numerical values, and the like may be used as necessary. Further, matters described in the embodiment and the modifications can be combined with one another as long as technical contradiction does not occur.

Note that the present disclosure can further include the following configurations.

(1)

An electronic component including a secondary side coil including a plurality of coil parts, in which each of the coil parts includes:

a plate-like base part;

a leg part formed on the base part; and a pin part formed at a tip of the leg part.

(2)

The electronic component according to (1), in which lengths of the leg parts of the plurality of coil parts are different from one another.

(3)

The electronic component according to (1) or (2), in which the secondary side coil includes a plurality of first coil parts and a plurality of second coil parts, each of the first coil parts includes:

a plate-like first base part;

a first leg part formed on the first base part; and a first pin part formed at a tip of the first leg part, and each of the second coil parts includes:

a plate-like second base part;

a second leg part formed to face the first leg part with respect to the second base part; and a second pin part formed at a tip of the second leg part.

(4)

The electronic component according to any one of (1) to (3), in which each of the leg parts of the plurality of coil parts is arranged along a predetermined direction.

(5)

The electronic component according to (4), further including a bus bar bonded to a substrate and the pin part via solder.

(6)

The electronic component according to (5), in which the bus bar includes a protruded part intersecting with the pin part, and a space into which the solder flows is formed between the pin part and the protruded part along the predetermined direction.

(7)

The electronic component according to (6), in which the bus bar includes a support part that integrally supports the plurality of coil parts.

(8)

The electronic component according to (7), in which a notch supported by the support part is formed in the leg part of each of the coil parts.

(9)

The electronic component according to any one of (1 to (8), in which each of the coil parts includes:

a planted part planted from the base part; and a flange part formed at a tip of the planted part.

(10)

The electronic component according to (9), in which lengths of the planted parts of the plurality of coil parts are different from one another.

(11)

The electronic component according to any one of (1 to (10), in which a hole is formed in a vicinity of the tip of the leg part.

(12)

The electronic component according to (11), in which a plurality of the holes is formed.

(13)

The electronic component according to (11) or (12), in which at least one of a position where the hole is formed in each of the coil parts or a size of the hole is different.

(14)

The electronic component according to any one of (1) to (13), in which lengths of the pin parts of the coil parts are different.

(15)

The electronic component according to any one of (1) to (14), in which the base part has a disc shape.

(16)

The electronic component according to (15), in which the leg part extends from one end side of the disk-shaped base part and the planted part is planted from another end side of the disk-shaped base part.

(17)

An electronic component including a secondary side coil including a plurality of coil parts, in which each of the coil parts includes:

a plate-like base part;

a leg part formed on the base part; and at least one of a pin part formed at a tip of the leg part or a hole formed in a vicinity of the tip.

(18)

A bonding structure including:

a plurality of first members arranged in a predetermined direction; and a second member that supports the plurality of first members, in which a solder inflow space along the predetermined direction is formed in a state where the plurality of first members is supported by the second member.

(19)

A power supply device including the electronic component according to any one of (1) to (17).

(20)

An electric vehicle including the power supply device according to (19).

REFERENCE SIGNS LIST

10 Transformer
13 Secondary side coil
13*a* First coil part
13*b* Second coil part
31, 32 Bus bar
131*a*, 132*a* Base part
131*c*, 132*c* Leg part
131*d*, 132*d* Pin part
131*e*, 132*e* Planted part
131*f*, 132*f* Flange part
135 Hole
312, 322 Protruded Part
313, 323 Support Part
131*g*, 131*h*, 132*g*, 132*h* Notch
SP Space

What is claimed is:

1. An electronic component, comprising:

a secondary side coil including a plurality of first coil parts and a plurality of second coil parts, wherein each of the first coil parts includes:

a plate-like first base part, wherein the plate-like first base part is disposed in a plane that is parallel to a first plane;

a first leg part formed so as to extend from the first base part, wherein the first leg part is disposed in a plane that intersects the first plane; and a first pin part formed at a tip of the first leg part, wherein each of the second coil parts includes:

a plate-like second base part wherein the plate-like second base part is disposed in a plane that is parallel to the first plane;

a second leg part formed so as to extend from the second base part, wherein the second leg part is disposed in a plane that intersects the first plane, and wherein the plane in which the second leg part is disposed is parallel to and spaced apart from the plane in which the first leg part is disposed; and a second pin part formed at a tip of the second leg part, and wherein the first coil parts are separated from the second coil parts.

2. The electronic component according to claim 1, wherein lengths of the first leg parts of the first plurality of coil parts are different from one another.

3. The electronic component according to claim 1, wherein each of the first leg parts of the first plurality of coil parts is arranged along a predetermined direction.

4. The electronic component according to claim 3, further comprising:

a bus bar bonded to a substrate and the first and second pin parts via solder.

5. The electronic component according to claim 1, wherein each of the first coil parts includes:

a first planted part planted from the first base part; and a flange part formed at a tip of the first planted part.

6. The electronic component according to claim 5, wherein lengths of the first planted parts of the first plurality of coil parts are different from one another.

7. The electronic component according to claim 1, wherein a hole is formed in a vicinity of the tip of the first leg part.

8. The electronic component according to claim 7, wherein a plurality of the holes is formed.

9. The electronic component according to claim 7, wherein at least one of a position where the hole is formed in each of the first coil parts or a size of the hole is different.

10. The electronic component according to claim 1, wherein lengths of the pin parts of the first coil parts are different.

11. The electronic component according to claim 1, wherein the first base part has a disc shape.

12. The electronic component according to claim 11, wherein the first leg part extends from one end side of the first base part and a first planted part is planted from another end side of the first base part.

13. A power supply device comprising the electronic component according to claim 1.

14. An electric vehicle comprising the power supply device according to claim 13.

15. The electronic component according to claim 1, wherein each of the first and second coil parts includes a plurality of pin parts formed at the tip of the respective leg parts.

16. An electronic component, comprising:

a secondary side coil including a plurality of coil parts, wherein each of the coil parts includes:

a plate-like base part, wherein the plate-like base part is disposed in a plane that is parallel to a first plane;

a leg part formed so as to extend from the base part, wherein the leg part is disposed in a plane that intersects the first plane, wherein each of the leg parts of the plurality of coil parts is arranged along a predetermined direction; and a pin part formed at a tip of the leg part; and a bus bar bonded to a substrate and the pin part via solder, wherein the bus bar includes a protruded part intersecting with the pin part, and a space into which the solder flows is formed between the pin part and the protruded part along the predetermined direction.

17. The electronic component according to claim 16, wherein the bus bar includes a support part that integrally supports the plurality of coil parts.

18. The electronic component according to claim 17, wherein a notch supported by the support part is formed in the leg part of each of the coil parts.

19. An electronic component, comprising:

a secondary side coil including a plurality of first coil parts and a plurality of second coil parts, wherein each of the first coil parts includes:

a plate-like first base part, wherein the plate-like first base part is disposed in a plane that is parallel to a first plane;

a first leg part formed so an to extend from the first base part, wherein the first leg part is disposed in a plane that intersects the first plane; and a first hole formed in a vicinity of a tip of the first leg part, wherein each of the second coil parts includes:

a plate-like second base part wherein the plate-like second base part is disposed in a plane that is parallel to the first plane;

a second leg part formed so as to extend from the second base part, wherein the second leg part is disposed in a plane that intersects the first plane, and wherein the plane in which the second leg part is disposed is parallel to and spaced apart from the plane in which the first leg part is disposed; and a first hole formed in a vicinity of a tip of the second leg part, and wherein the first coil parts are separated from the second coil parts.

* * * * *